United States Patent [19]

Malcolm

[11] Patent Number: 4,971,256

[45] Date of Patent: Nov. 20, 1990

[54] SPRINKLER DEVICE

[76] Inventor: William R. Malcolm, 43360 Werney Rd., Coarsegold, Calif. 93614

[21] Appl. No.: 253,235

[22] Filed: Oct. 4, 1988

[51] Int. Cl.[5] ..... B05B 3/04

[52] U.S. Cl. ..... 239/230; 239/241; 239/259; 239/DIG. 1

[58] Field of Search ..... 239/230, 240, 241, 259, 239/260, DIG. 1

[56] References Cited

U.S. PATENT DOCUMENTS

| | | | |
|---|---|---|---|
| 1,845,364 | 2/1932 | Thompson | 239/259 |
| 2,928,608 | 3/1960 | Royer | 239/230 |
| 3,669,353 | 6/1972 | Hanson et al. | 239/DIG. 1 |
| 3,680,778 | 8/1972 | Sisson et al. | 239/DIG. 1 |
| 3,764,073 | 10/1973 | Costa et al. | 239/230 |
| 3,799,631 | 3/1974 | Martina | 239/230 |
| 3,874,588 | 4/1975 | Flynn | 239/230 |
| 3,957,205 | 5/1976 | Costa | 239/230 |
| 4,103,828 | 8/1978 | Ridgway | 239/230 |
| 4,474,328 | 10/1984 | Hale | 239/DIG. 1 |
| 4,687,139 | 8/1987 | Lockwood | 239/240 |
| 4,819,875 | 4/1989 | Beal | 239/DIG. 1 |

*Primary Examiner*—Andres Kashnikow
*Assistant Examiner*—Michael J. Forman
*Attorney, Agent, or Firm*—Lyon & Lyon

[57] ABSTRACT

A rotary sprinkler device having a fluid inlet adapted to be secured to a water line, a nozzle head defining a plurality of differently configured or sized outlet orifices therein, a body member disposed between the fluid inlet and the nozzle head, a bearing spindle at least partially disposed within the body member and selectively communicating the fluid inlet with one of the outlet orifices in the nozzle head for obtaining the desired water distribution therefrom. The bearing spindle is mounted for relative rotation between the bearing spindle and the body member. A ball drive is disposed within the body member. The ball drive is operatively connected to the nozzle head and responsive to fluid flow through the bearing spindle to the nozzle head for rotating the nozzle head. A swirl plate is disposed between the fluid inlet and the ball drive and defines a plurality of angularly disposed openings therein for causing water passing therethrough to swirl about the ball drive and efficiently drive the ball therein in a tangential horizontal direction about and against the drive, causing incremental rotation of the nozzle head with minimal pressure drop. A plurality of axially aligned and abutting sealing washers are disposed about a portion of the bearing spindle and extend axially between a second portion of the bearing spindle and a portion of the body member, and a wave spring for preloading the sealing washers in compression is disposed between the second portion of the bearing spindle and said portion of the body member to maintain a continuous seal therebetween.

20 Claims, 12 Drawing Sheets

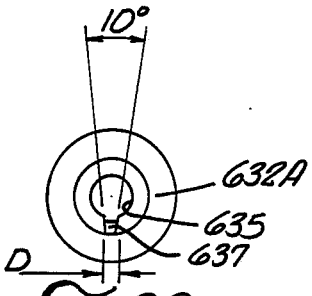
FIG. 33a.
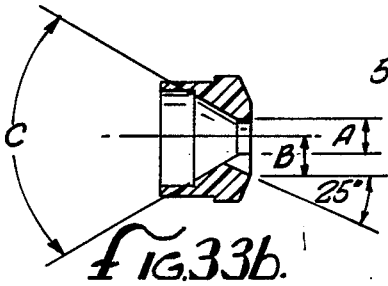
FIG. 33b.
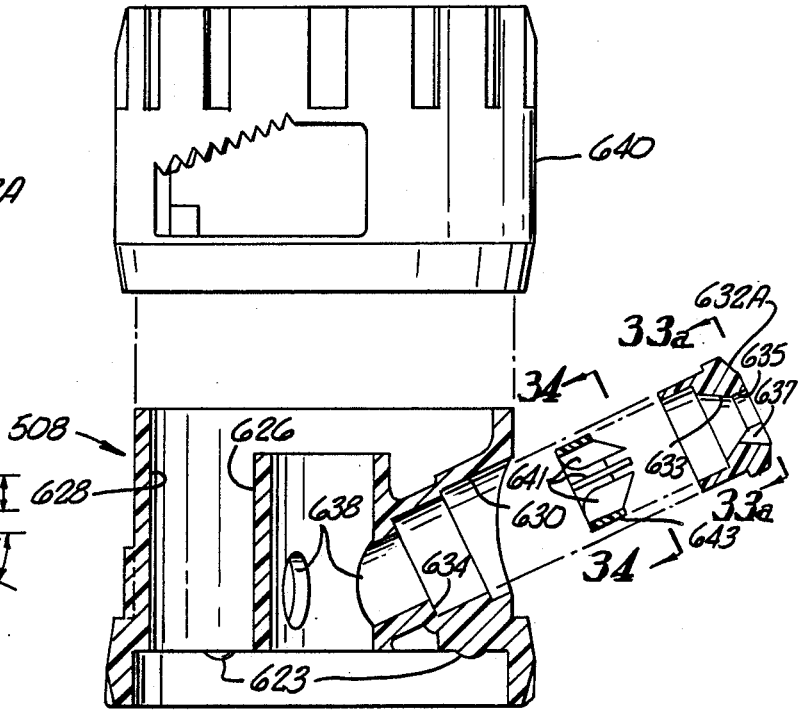
FIG. 32a.
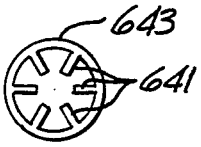
FIG. 34.
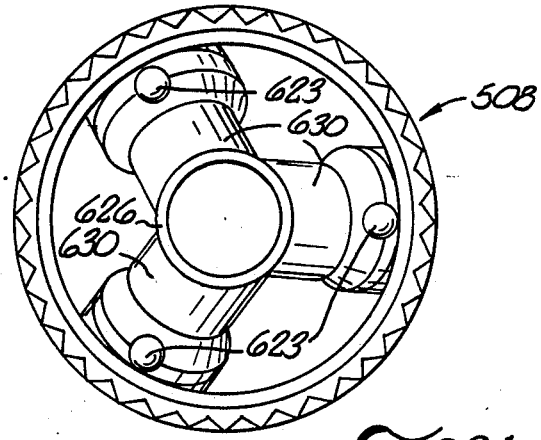
FIG. 32b.
| NOZZLE ELEMENT | A | B | C | D | NOZZLE COLOR |
|---|---|---|---|---|---|
| 632 A | .109 | .120 | 60° | .028 | GREEN |
| 632 B | .150 | .140 | 48° | .033 | YELLOW |
| 632 C | .187 | .165 | 34° | .038 | RED |
| 632 D | .218 | .190 | 24° | .043 | BLUE |
FIG. 35.

SPRINKLER DEVICE

BACKGROUND OF THE INVENTION

The present invention relates to a new and improved, highly efficient, impact drive rotatable sprinkler device which is capable of evenly distributing very low volumes of water over a large area and can be provided with means for readily adjusting the segment of a circle to be watered (arc of throw) without affecting the amount of water distributed over the selected area per unit time.

Ball driven impact sprinklers are well known and have been manufactured and sold for many years. They have not, however, been well accepted by consumers because of their relatively short life expectancies, high pressure losses, undependable speed of rotation, poor water distribution, and lack of flexibility and ease of adjustment. Several of these problems are primarily the result of the particular drive mechanisms employed in such devices. These drive mechanisms generally operate in the same manner. As water is directed to the drive chamber, it is channeled through very small angular openings which greatly restrict the flow while significantly increasing its velocity, resulting in very small high velocity streams of water which enter the drive chamber at an inclined angle, forming a water vortex within the drive chamber. The drive ball, which is free to move in any direction within the drive chamber, is placed into rotation by the water vortex. The centrifugal force of the rotating ball moves the ball to the outer diameter of the drive chamber. The force of the swirling water vortex within the chamber move the ball upwardly and around the chamber, building the ball's velocity to a maximum just before it reaches the rotary portion of the sprinkler head which extends down into the drive chamber. The ball then strikes a lug, moving the sprinkler head a small amount. The ball then loses velocity, falls back into the bottom of the drive chamber, and the cycle is repeated.

As these devices rely entirely on the force of the impact of the ball to drive the sprinkler about its axis of rotation, the size of the steel drive ball must be relatively large, on the order of one-half inch in diameter. The drive chamber must also be relatively large, on the order of 3.5 inches across, to accommodate such travel of the ball. The introduction of high velocity water into a relatively large chamber and the repeated vertical lifting and dropping of the drive ball creates a large pressure drop across the sprinkler. In addition, the continued lifting and dropping of the ball within the chamber causes significant and rapid wear on the interior of the sprinkler. The result is an efficient drive mechanism and a short sprinkler life.

In addition to the problems resulting from the drive mechanisms in ball impact drive sprinklers, such devices have also suffered in performance as a result of this poor seal designs. The means for sealing such drive mechanisms are continuously subject to imbalance by reason of the force of the water spraying from only one side of the sprinkler. This imbalance is greatly exacerbated if one were to press downwardly on the sprinkler head during use. The uneven forces acting on the sprinkler seals tend to open the seals about the central axis of the sprinkler, creating leakage problems and allowing foreign matter to pass therein which adversely affects the rotation and thus the water distribution and life of the sprinkler.

On those ball impact drive sprinklers having means for presetting the arc of throw, not only are they difficult to adjust, requiring the use of tools and often additional parts, but there is generally no means to vary the volume of flow through the sprinkler to correspond with the preset arc of throw. As a result, a sprinkler which is spraying over a 90° arc of throw would cover that area with four times the amount of water in a given amount of time as the same sprinkler dispersing water over 360°. This results in uneven water coverage when different sprinklers in a sprinkler line are preset to different arcs of throw. In addition, the means for presetting the arc of throw in such sprinklers are very susceptible to damage. Such devices generally do not include clutch mechanisms. If one were to manually rotate the nozzle head of the sprinkler with respect to the sprinkler body, the impacting lugs which control the arc of throw and would be easily damaged. The present invention is directed to solutions to these problems while maintaining the economy of ball impact drive sprinklers.

To improve the efficiency and longevity of the drive mechanism, the present invention does not utilize high velocity jets of water to create a vortex for lifting, rotating and dropping the drive ball about and within a large drive chamber. Instead, a smaller and lighter drive ball is confined to a tight annular track about a small drive chamber, shaped to fit the ball. The ball is propelled about the track by three or more relatively low velocity streams of water which enter the drive chamber at an angle substantially tangential to the direction of travel of the ball. The formation of the low velocity streams does not sufficiently restrict the flow of water through the sprinkler so as to create an excessive pressure loss. The ball impact surfaces for the sprinkler are formed in the wall of the ball track and are shaped so as to fit the ball, allowing the rotating ball to impact and roll over the impact surfaces thereby greatly reducing the amount of wear in comparison to that heretofore experienced with vortex flow drive mechanisms. The impact surfaces also deflect the tangential water streams applying further rotary torque to the wall of the ball track. While the torque created by the impacting water alone is insufficient to rotate the track, the additional torque imparted by the impacting ball rotates the drive track an incremental amount with each impact, thereby effecting the desired slow rotation of the drive chamber which carries the rotary section of the sprinkler. As a result of this new configuration of ball track and drive chamber and by more efficiently utilizing the water flow through the drive chamber and maintaining uniform water flow from the water streams about the track and out the sprinkler nozzle, the need for high velocity water jets and the creation of a water vortex is eliminated, dramatically improving the efficiency and life of the sprinkler.

In addition to the improved drive mechanism, the present invention also employs a novel, pre-loaded seal assembly which not only protects the bearing surfaces from the intrusion of foreign matter, but also controls the bearing friction between the rotating and stationary sprinkler parts. This seal assembly comprises a plurality of stacked bearing and seal washers which are spring biased so as to evenly distribute the loading forces acting thereon and thus continuously maintain the desired bearing friction and eliminate the aforesaid seal separation problem even in those most severe instances where the sprinkler is subjected to a downward vertical force during use. In different embodiments of the present invention, means are provided for adjusting the arc of throw of the sprinkler so that the sprinkler will cover only a preset area. Not only is such means readily adjustable without the need for separate tools or additional parts, but includes cooperating means for varying the flow of water through the sprinkler so as to provide continuously uniform water coverage per unit time regardless of the preset arc of throw. Additionally, a clutch assembly is provided for allowing the sprinkler head to be manually rotated with respect to the sprinkler body without damaging the direction control mechanism and while maintaining the preset arc of throw. As will become apparent, the impact ball drive sprinkler disclosed herein overcomes each of the shortcomings heretofore experienced with such devices while maintaining the economic advantages of the ball drive mechanism.

SUMMARY OF THE INVENTION

Briefly, the present invention comprises an improvement in rotary sprinklers of the ball impact drive type wherein the drive ball is propelled about a tight annular ball track by a plurality of relatively low velocity streams of water directed substantially tangential to the track. A protruding surface is provided in the track which is impacted by the incoming streams of water and by the drive ball with each pass thereof about the track, causing a slow incremental rotation of the track and the sprinkler nozzle head carried thereby. A plurality of stacked sealing and bearing washers are disposed about a bearing spindle for preventing the intrusion of foreign matter to the bearing surfaces of the sprinkler and for controlling the bearing friction of the sprinkler. A wave spring preloads the sealing and bearing washers against the bearing spindle for controlling the bearing friction and to maintain the washers in continuous parallel alignment and sealing engagement during use. Means can be provided for presetting the arc of throw of the sprinkler and correspondingly varying the fluid flow through the sprinkler to provide constant uniform water coverage per unit time regardless of the arc of throw to which the sprinkler is set. A clutch assembly is provided to disengage temporarily the means for presetting the arc of throw to avoid damage thereto upon manual forceful rotation of the sprinkler head about and with respect to the sprinkler body, and to reengage said means upon cessation of such manual rotation while maintaining the preset arc of throw.

It is the principal object of the present invention to provide an improved rotary sprinkler of the ball impact drive type.

It is another object of the present invention to provide a rotary sprinkler of the ball impact drive type which has less pressure drop across the sprinkler than those rotary sprinklers of the ball impact type heretofore available.

It is another object of the present invention to provide a rotary sprinkler of the ball impact drive type which is less susceptible to damage by the movement of the drive ball than are those rotary type sprinklers of the ball impact type heretofore available.

It is a further object of the present invention to provide a rotary sprinkler of the ball impact type which has improved sealing means therein for preventing the intrusion of foreign matter to the bearing surfaces of the sprinkler.

It is yet another object of the present invention to provide a rotary sprinkler having a sealing assembly therein for maintaining continuous watertight sealing and controlled frictional engagement between rotating and stationary elements of the sprinkler upon the rotating elements being subjected to uneven loading.

It is a still further object of the present invention to provide a rotary sprinkler of the ball impact drive type which is readily adjustable without the need for additional parts or tools for presetting the arc of throw of the sprinkler.

It is another object of the present invention to provide a rotary sprinkler of the ball impact type which provides relatively constant uniform coverage per unit time over different present arcs of throw.

It is a still further object of the present invention to provide a rotary sprinkler of the ball impact type having readily adjustable preset arcs of throw wherein the sprinkler head can be manually rotated about and with respect to the sprinkler body without damaging the sprinkler or interfering with the preset arc of throw.

It is a still further object of the present invention to provide a rotary sprinkler of the ball impact drive type which is readily adjustable to vary the volume of flow therethrough, the area of coverage, the speed of rotation and the configuration and range of the spray emanating therefrom.

These and other objects and advantages of the present invention will become apparent from the following description taken in conjunction with the accompanying drawings.

IN THE DRAWINGS

Figure 14:
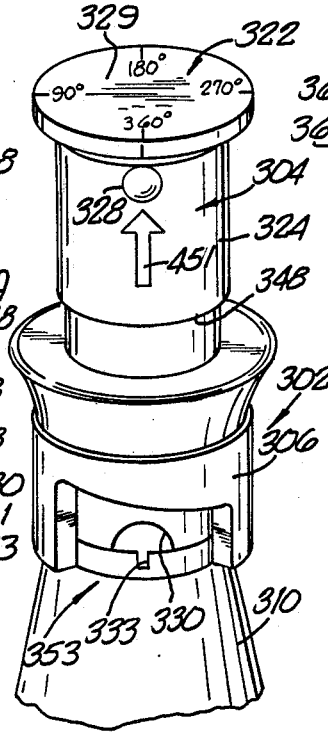
FIG. 14 is a perspective view of the cap assembly, nozzle head, nozzle deflector and the upper portion of the bearing guard of the third embodiment.

FIG. 15B—15E are a series of sectional views taken along line 15A—15A in FIG. 14 but illustrating the relative movement of the trip cap and trip collar with respect to the trip shaft as the sprinkler of the third embodiment undergoes a continuous 270° arc of throw.

Figure 16:
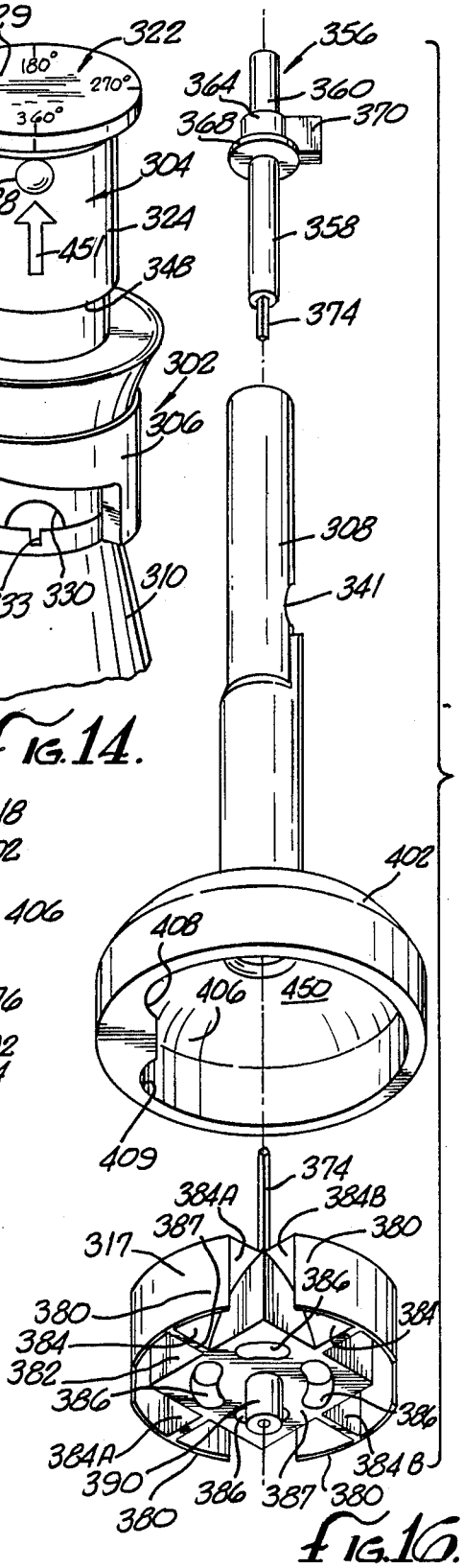

FIG. 16 is an exploded perspective view of the trip shaft, direction control shaft, bearing spindle and swirl plate of the third embodiment.

Figure 17:
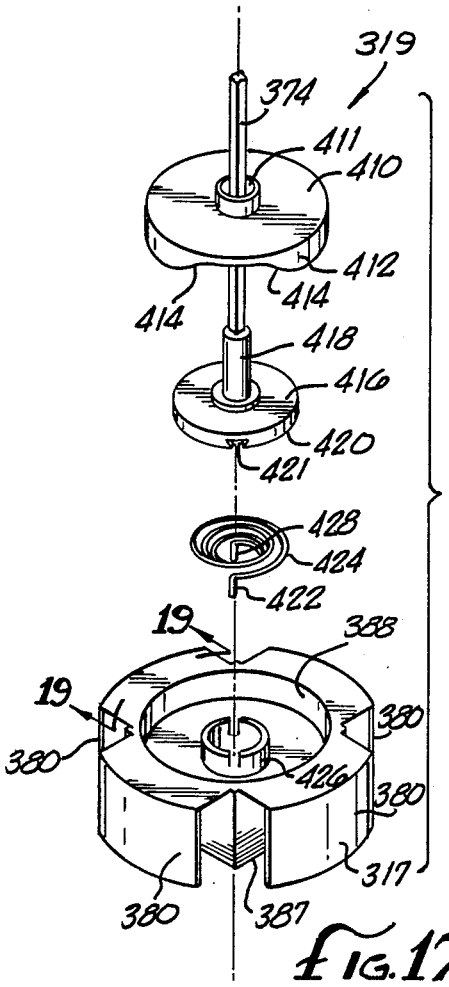

FIG. 17 is an exploded perspective view of the swirl plate and clutch assembly of the third embodiment.

Figure 18:
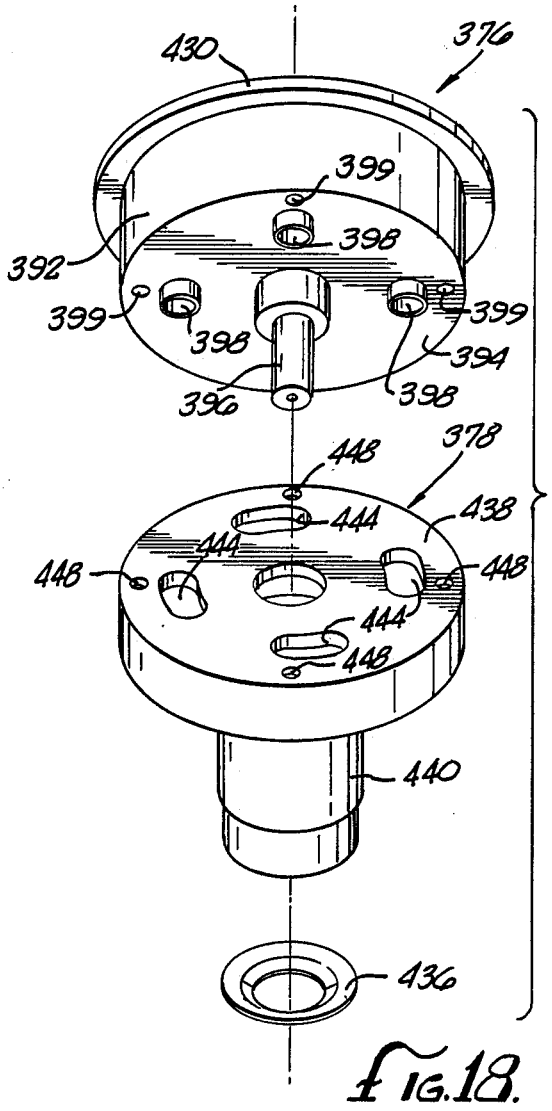

FIG. 18 is an exploded perspective view of the swirl plate housing, flow selector and push nut.

Figure 19:
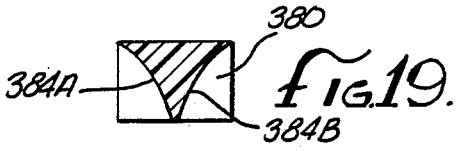
Figure 15:
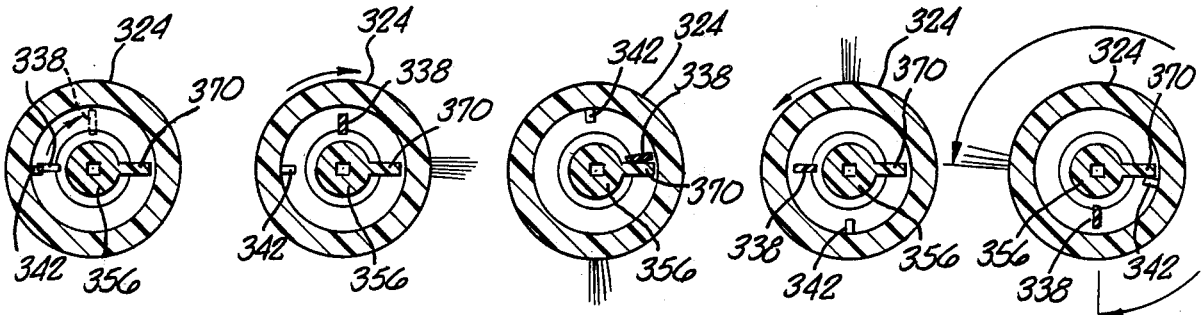
FIGS. 15A is a sectional view taken along the line 15A—15A in FIG. 14.

FIG. 19 is an enlarged sectional view taken along line 19—19 in FIG. 17.

Figure 20:
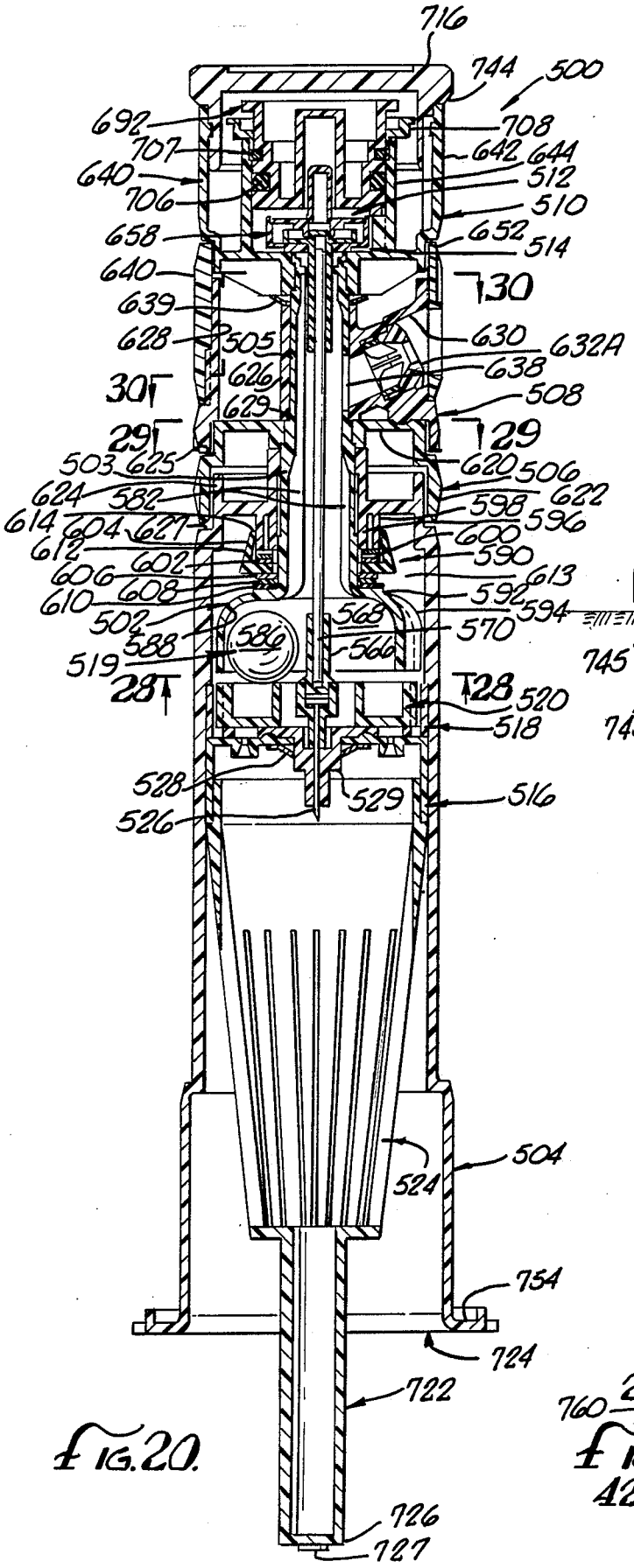

FIG. 20 is a sectional side view of a fourth embodiment of a sprinkler device of the present invention.

Figure 21:
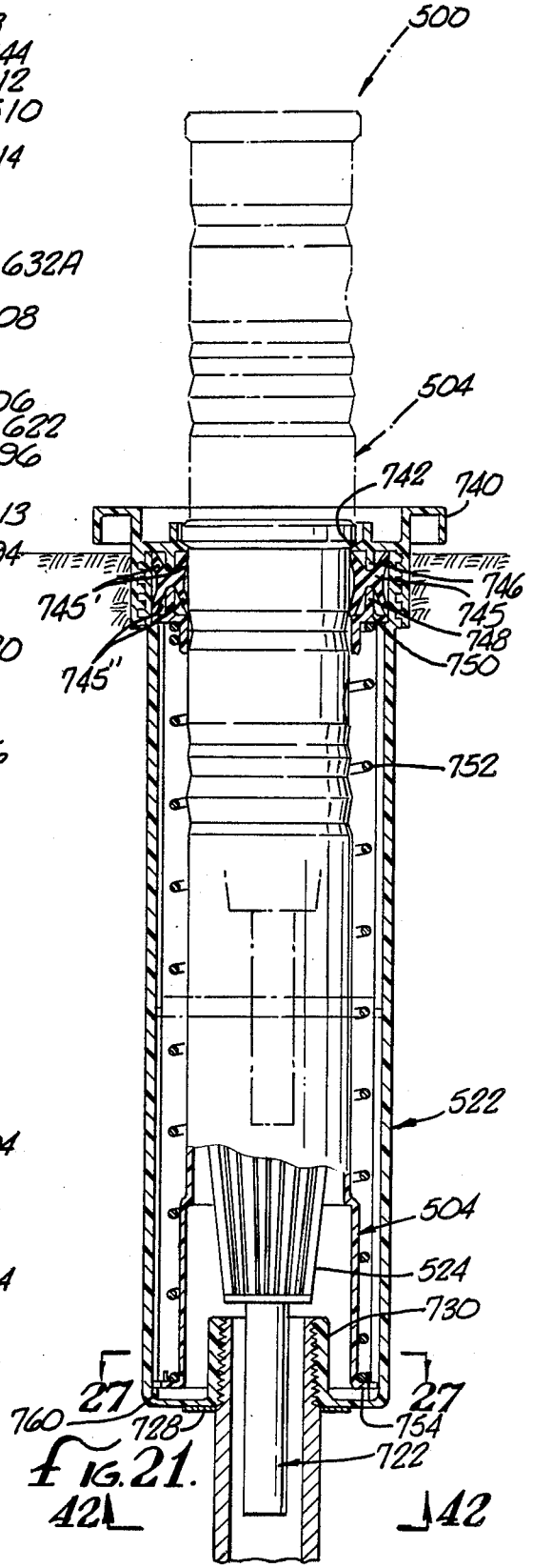

FIG. 21 is a sectional side view of the outer casing and sealing means of the fourth embodiment, illustrating the popup feature of the sprinkler device in phantom lines.

Figure 22A:
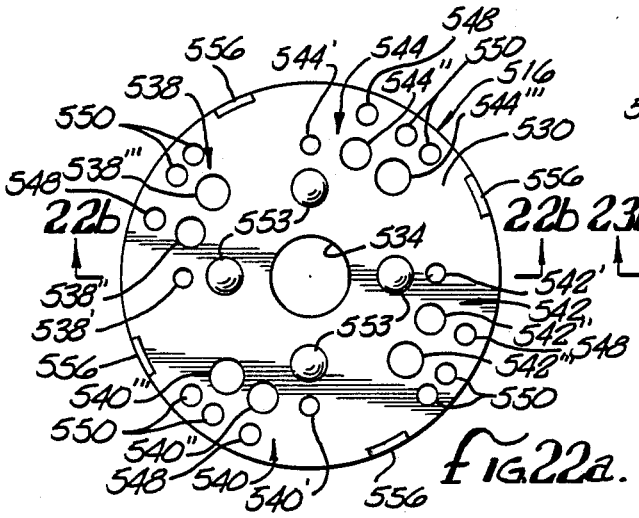
Figure 22B:
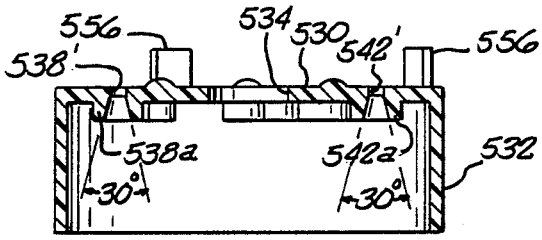
Figure 22C:
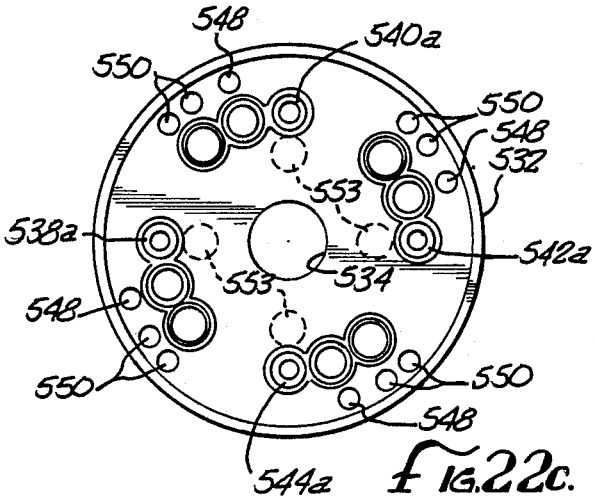

FIGS. 22*a*—22*c* are top, sectional, side and bottom views, respectively, of the flow selector of the fourth embodiment of the present invention.

Figure 23A:
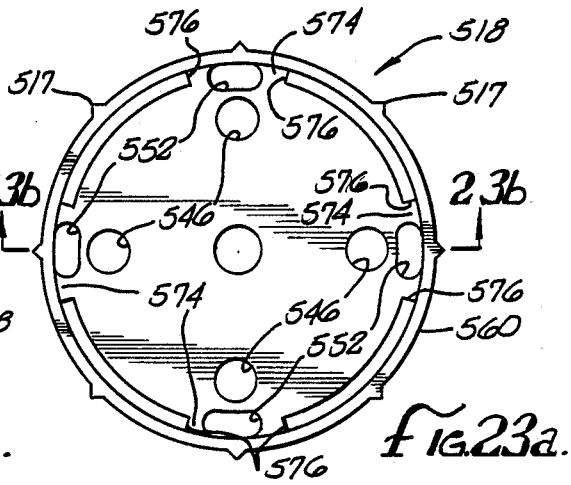
Figure 23B:
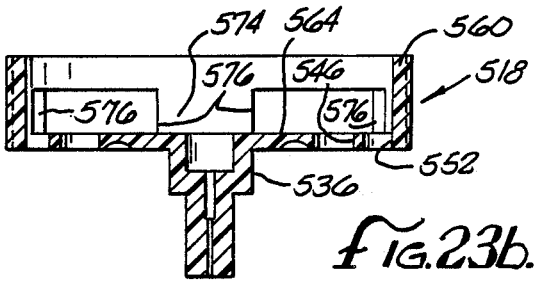
Figure 23C:
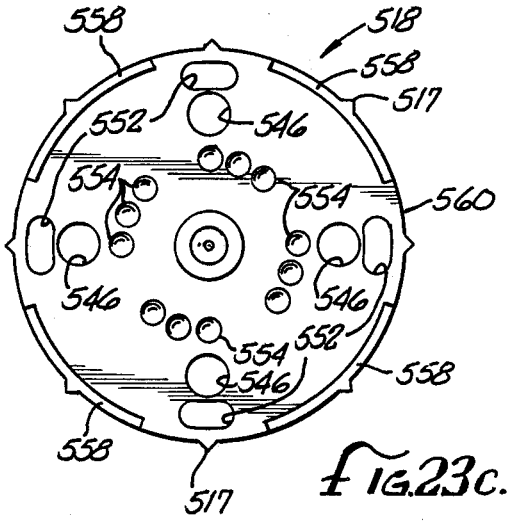

FIGS. 23*a*—23*c* are top, sectional, side and bottom views, respectively, of the swirl plate housing of the fourth embodiment of the present invention.

Figure 24:
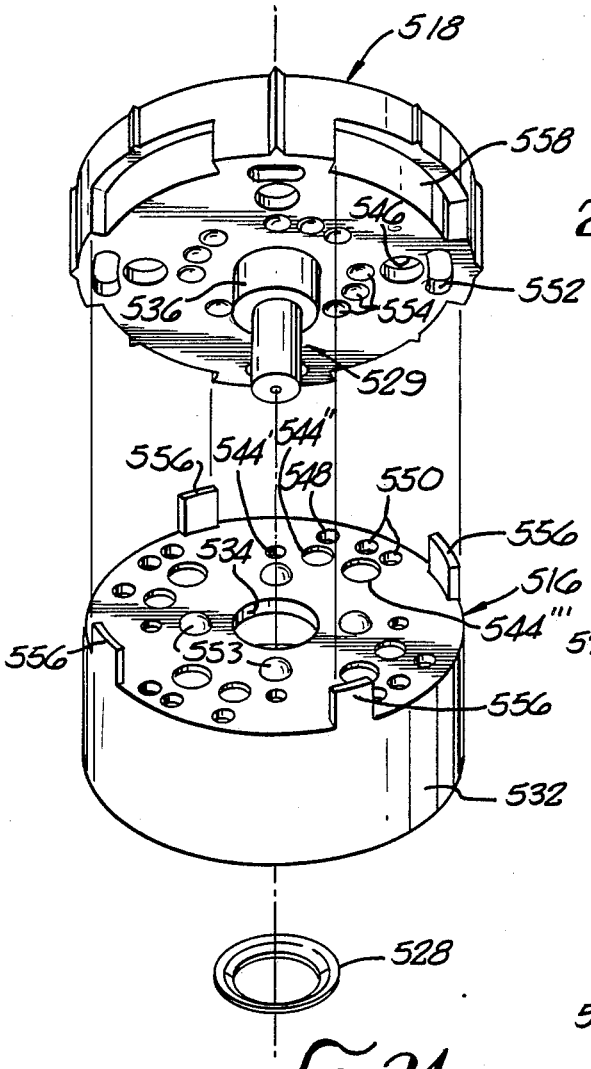

FIG. 24 is an exploded perspective view of the flow selector and swirl plate housing of the fourth embodiment of the present invention.

Figure 25A:
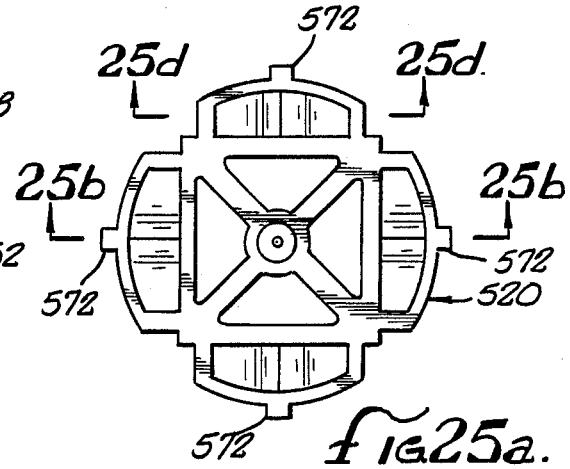
Figure 25B:
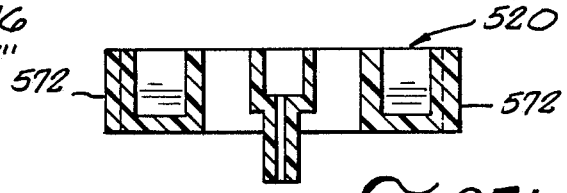
Figure 25C:
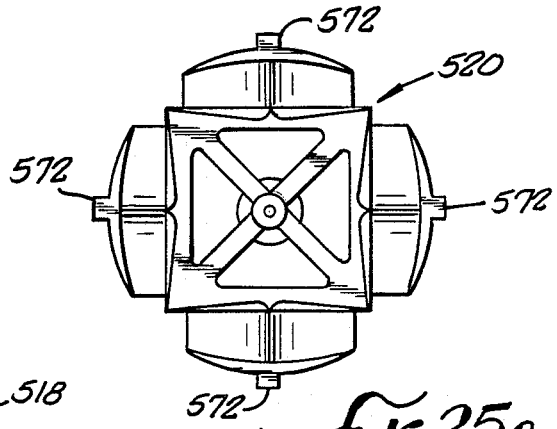

FIGS. 25*a*–25*c* are top, sectional, side and bottom views, respectively, of the swirl plate of the fourth embodiment of the present invention.

Figure 25D:
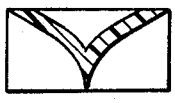

FIG. 25*d* is a sectional side view of one of the "V"-shaped deflection ribs of the swirl plate of the fourth embodiment of the present invention.

Figure 26:
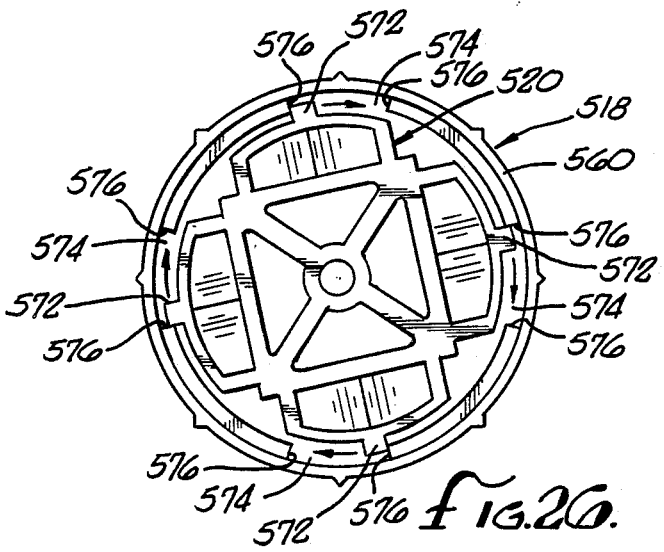

FIG. 26 is a top view of the swirl plate mounted within the swirl plate housing and illustrating the limited rotational movement of the swirl plate within the swirl plate housing.

Figure 27:
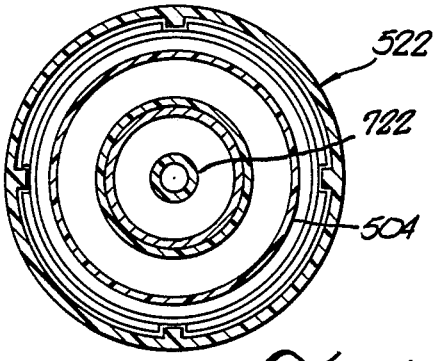

FIG. 27 is a sectional view taken along line 27—27 in FIG. 20.

Figure 28:
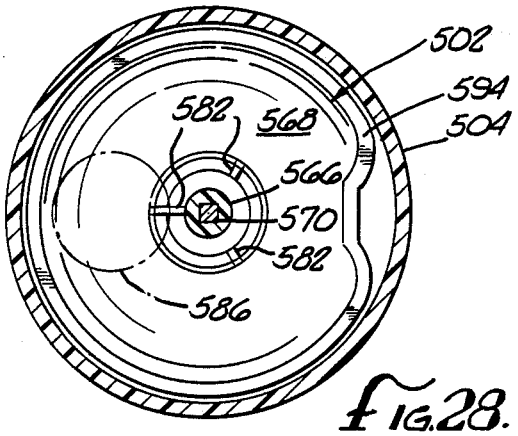

FIG. 28 is a sectional view taken along line 28—28 in FIG. 20.

Figure 29:
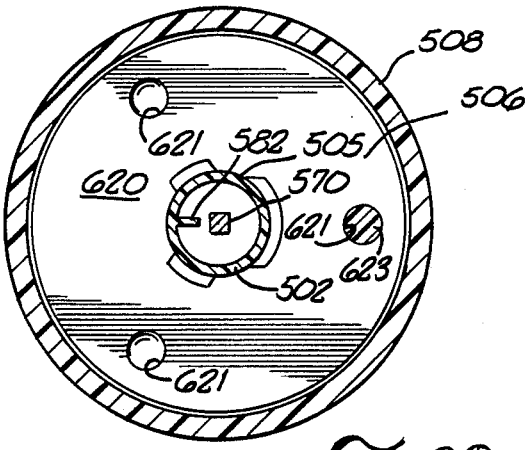

FIG. 29 is a sectional view taken along line 29—29 in FIG. 20.

Figure 30:
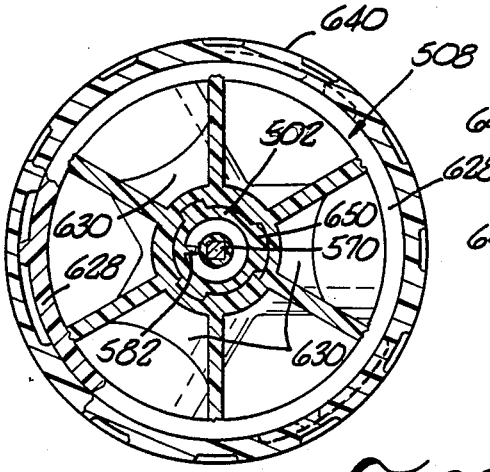

FIG. 30 is a sectional view taken along line 30—30 in FIG. 20.

Figure 31A:
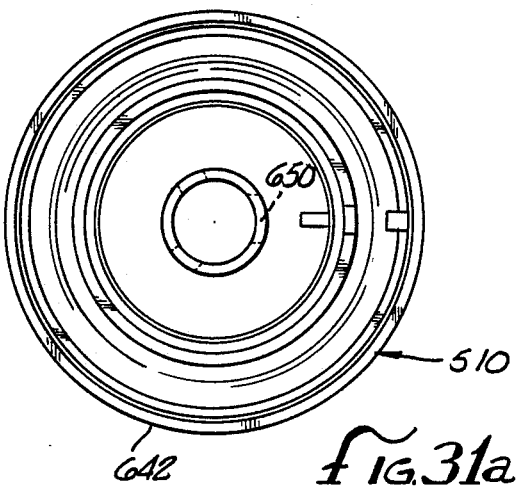
Figure 31B:
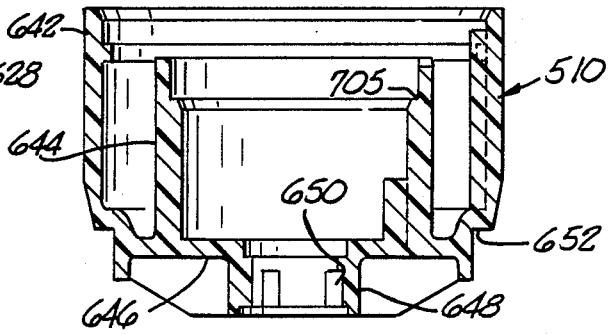

FIGS. 31*a*–31*b* are top and sectional side views, respectively, of the clutch housing of the fourth embodiment of the present invention.

FIG. 32*a* is a partial sectional side view of the nozzle head, nozzle deflector and nozzle element of the fourth embodiment of the present invention.

FIG. 32*b* is a bottom view of the nozzle head of the fourth embodiment of the present invention.

FIG. 33*a* is a sectional view taken along line 33*a*—33*a* in FIG. 32B.

FIG. 33*b* is a sectional view of a nozzle element of the fourth embodiment of the present invention illustrating the dimensional parameters thereof.

FIG. 34 is an end view of a nozzle element straightening vane of the fourth embodiment of the present invention.

FIG. 35 is a table referring to FIGS. 33*a* and 33*b* and setting forth the dimensional parameters of the nozzle element of the fourth embodiment of the present invention.

Figure 36:
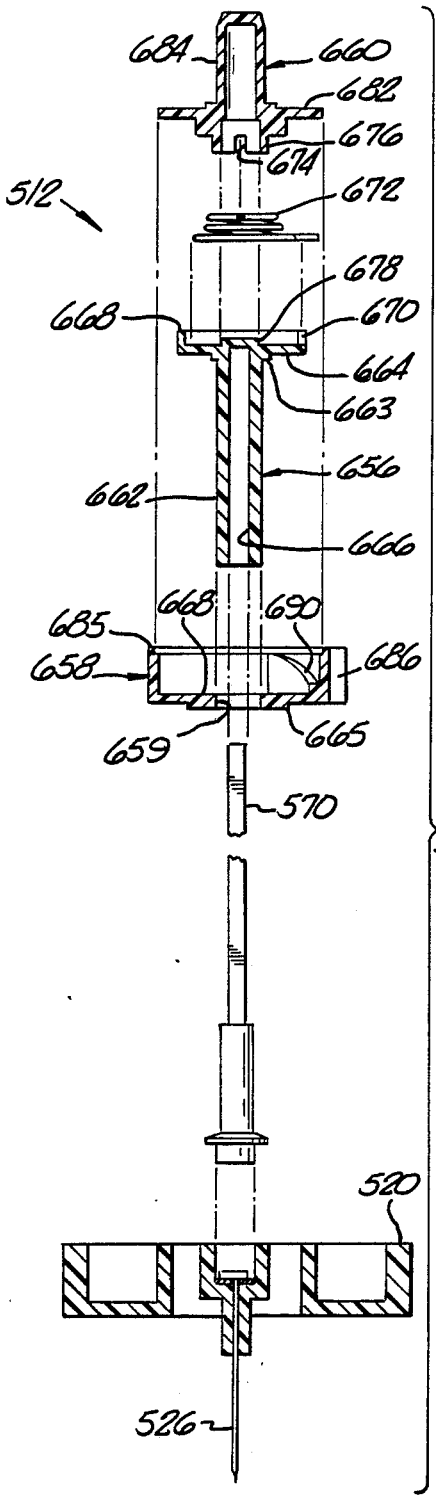

FIG. 36 is an exploded perspective view of the clutch assembly of the fourth embodiment of the present invention.

Figure 37:
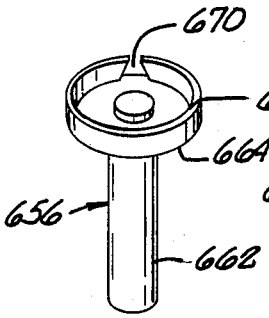

FIG. 37 is a perspective view of the clutch member of the fourth embodiment of the present invention.

Figure 38:
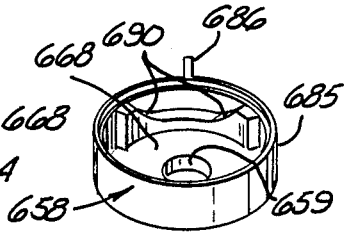

FIG. 38 is a perspective view of the inner trip housing of the fourth embodiment of the present invention.

Figure 39:
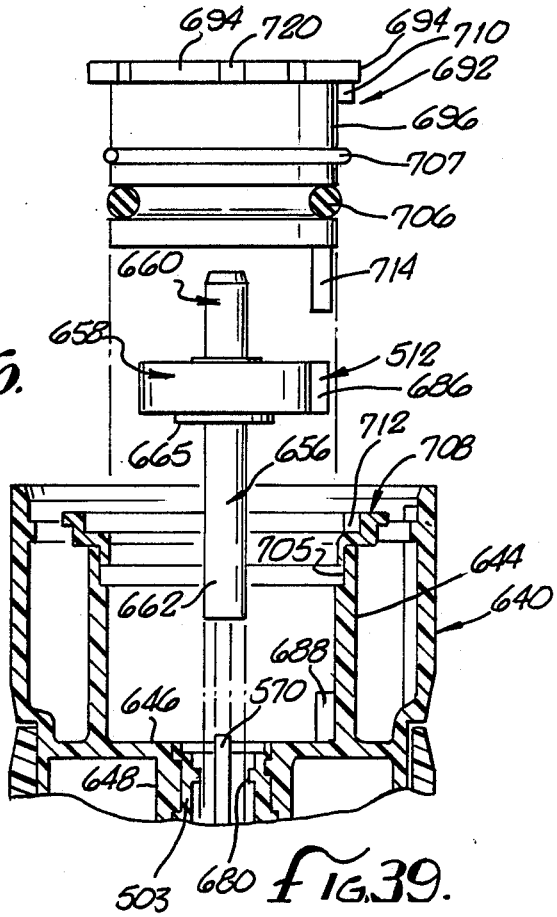

FIG. 39 is an exploded partial sectional view of the clutch housing, clutch assembly and direction control member of the fourth embodiment of the present invention.

Figure 40A:
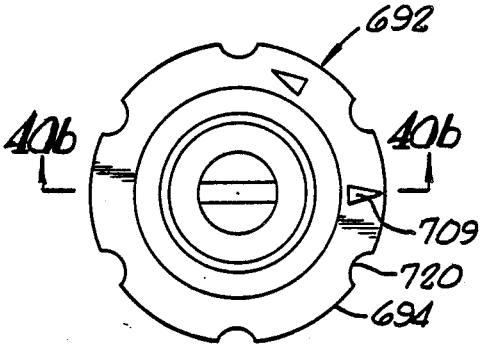

FIG. 40*a* is a sectional view of the direction control member of the fourth embodiment of the present invention.

Figure 40B:
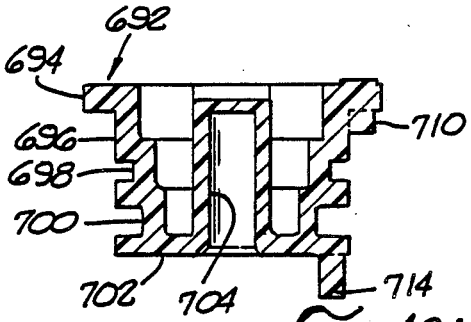

FIG. 40*b* is a sectional view taken along line 40B—40B in FIG. 40A.

Figure 40C:
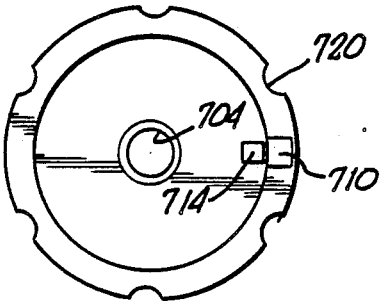

FIG. 40*c* is a bottom view of the direction control member of the fourth embodiment of the present invention.

Figure 41A:
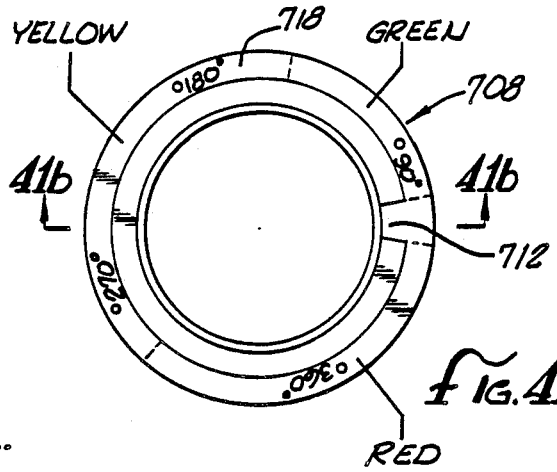
Figure 41B:
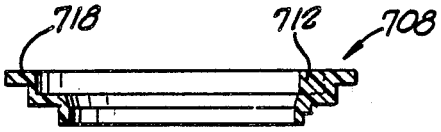
Figure 41C:
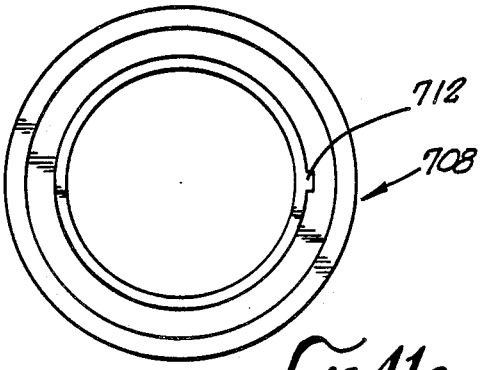

FIGS. 41*a*–41*c* are top, side and bottom views, respectively, of the direction control ring of the fourth embodiment of the present invention.

Figure 42:
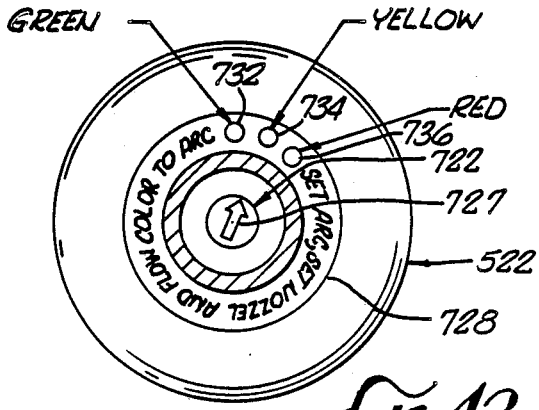

FIG. 42 is a bottom view of the fourth embodiment of the present invention illustrating the alignment indicia provided thereon.

DESCRIPTION OF PREFERRED EMBODIMENTS

THE FIRST EMBODIMENT

The first embodiment of the present invention illustrated in FIGS. 1–5, is configured to provide a low cost 360° rotational spray sprinkler device 10 for agricultural use. The sprinkler 10 generally comprises a nozzle head 12 which is affixed to the upper end of a cylindrical body 14 and is rotatably driven therewith by a ball drive mechanism 16 about a centrally disposed bearing spindle 20. Sealing means 18 is provided between the sprinkler body 14 and bearing spindle 20 to control the bearing friction therebetween and, with bearing nut 22 and filter element 24, prevent foreign matter from entering into and interfering with the operation of the sprinkler device 10.

Figure 1:
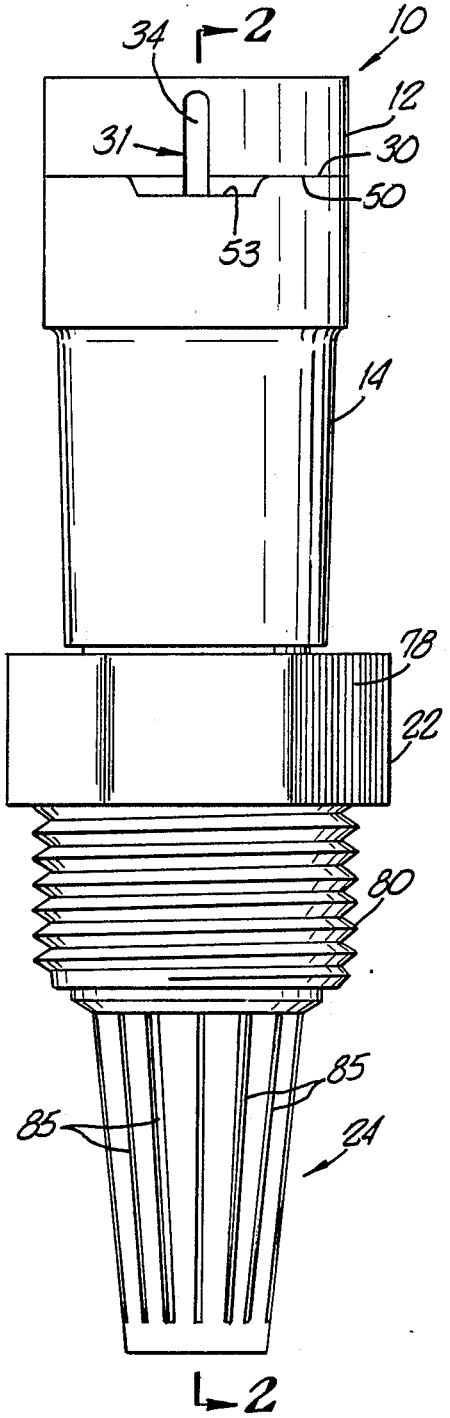
FIG. 1 is a side view of a sprinkler device of the present invention.
Figure 2:
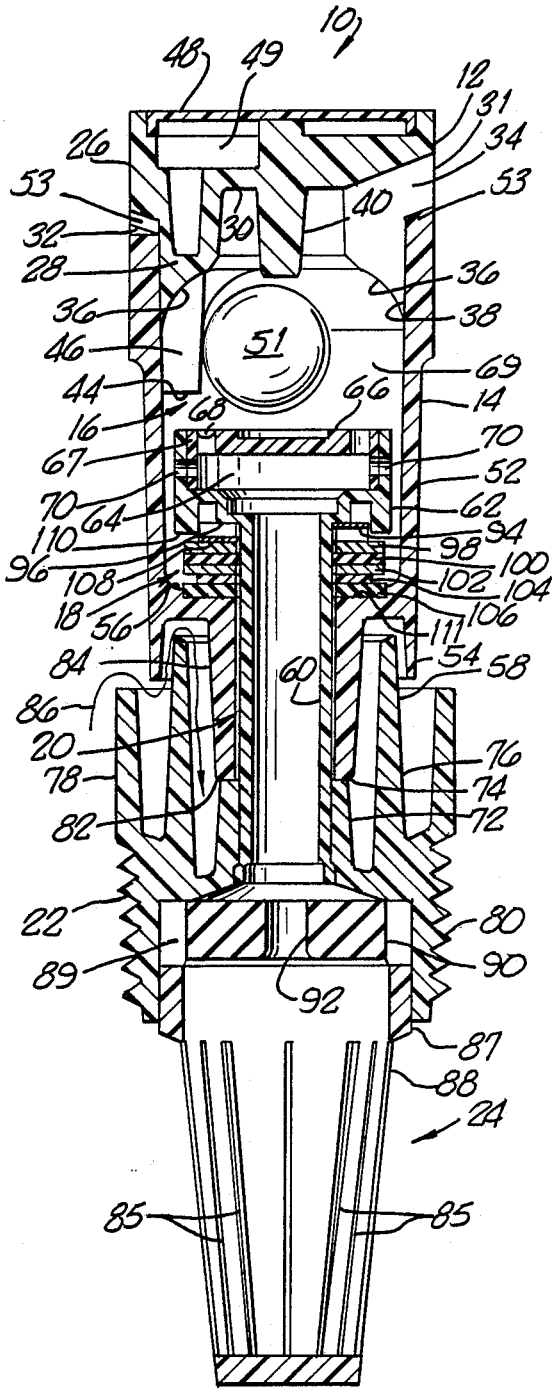
FIG. 2 is a sectional view taken along line 2—2 in FIG. 1.

The nozzle head 12 defines an upper cylindrical wall portion 26, a depending cylindrical inner wall portion 28 and an upper horizontal closure wall 30. The inner wall portion 28 is preferably hollow as seen in FIG. 1 to reduce material costs and is of a reduced diameter, defining an inclined abutment shoulder 32 with wall portion 26 and is integrally formed with the upper wall portion 26 and closure surface 30. A radially aligned vertical slot 34 extends through wall portions 28 and 26, shoulder 32 and a portion of the upper closure wall 30 to define the upper portion of the water outlet aperture 31 of the sprinkler device 10.

The lower interior surface of inner wall portion 28 defines a curvilinear depending arcuate ball track 36 extending about the interior of nozzle element 12 terminating in the lower end 38 of inner wall portion 28. A centrally disposed cylindrical ball stop 40 depends from closure wall 30 which is inwardly spaced from the ball track 36. The extended end of stop 40 lies in a plane approximately coincident with the upper end of the ball track surface 36.

Figure 3:
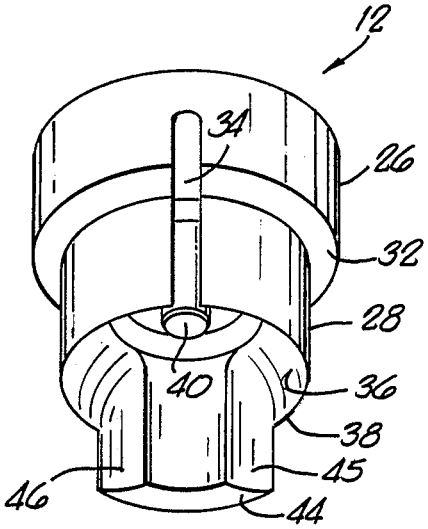
FIG. 3 is a perspective view of the sprinkler nozzle head.
Figure 5:
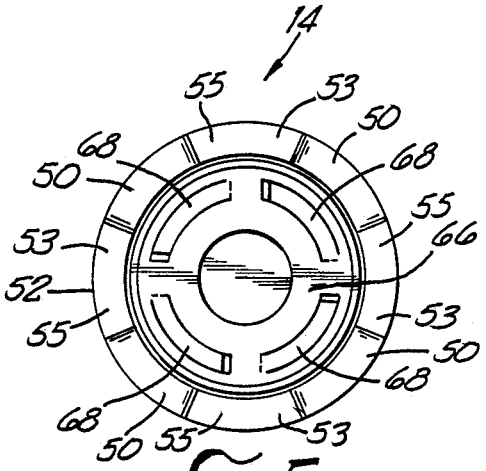
FIG. 5 is a top view of the sprinkler body.

As best seen in FIG. 3, lower wall portion 28 of nozzle head 12 also includes a depending skirt 44 extending about a portion thereof opposite slot 34. The outer surface of skirt 44 is continuous with and defines the same outer radius of curvature as the outer surface of wall portion 28. The interior surface of skirt 44 defines a pair of angularly disposed protruding slightly curved surfaces 45 and 46 which project inwardly from ball track 36. A cap 48 is secured in the upper end of nozzle head 12 to cover the cavity 49 in the upper end of the nozzle head 12 formed during manufacture. The nozzle element 12 is rigidly carried in the upper end of the sprinkler body 14 such that the outer surface of wall portion 28 presses against the inner surface of body 14 and the tapered upper end 50 of body 14 abuts and mates with tapered shoulder 30.

As will be hereinafter more fully described, nozzle head 12 and sprinkler body 14 are rotatably mounted on bearing nut 22 by means of bearing spindle 20. The sprinkler head 12 and body 14 are caused to rotate with respect to bearing nut 22 and bearing spindle 20 by a drive ball 51 which is continuously driven around ball track 36 by the water passing under pressure through the bearing spindle 20 and sprinkler body 14. As ball 51 is driven about track 36, it repeatedly impacts the protruding ball contact cam surface 46 on skirt 44, effecting rotation of the nozzle head 12 and sprinkler body 14.

Figure 4A:
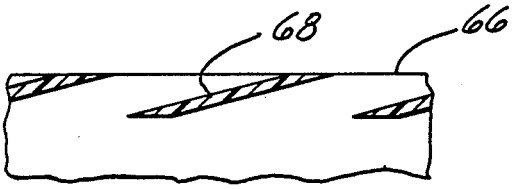
FIG. 4A is an enlarged sectional view taken along line 4—4 in FIG. 4.
Figure 4:
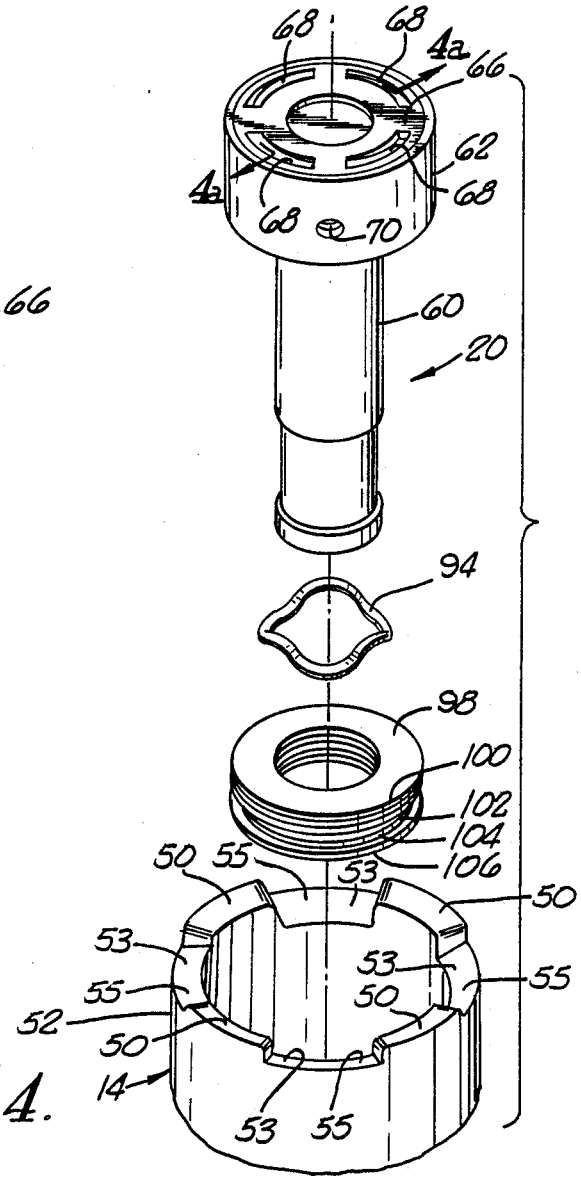
FIG. 4 is an exploded view of the bearing spindle, sealing spring and washers and the upper portion of the sprinkler body.

The sprinkler body 14 is of integral construction and includes a cylindrical wall portion 52 terminating at its lower end in a depending skirt portion 54. An annular horizontal seal support surface 56 is disposed inwardly of and above skirt portion 54 and a cylindrical hollow stem portion 58 extends downwardly from surface 56 below and inwardly spaced from skirt portion 54. As seen in FIG. 4, the upper end 50 of the sprinkler body 14 defines a plurality of horizontally disposed recessed areas 53 therein (four being shown), one of which is centrally aligned with vertical slot 34 during manufacture so as to define an inverted "T"-shaped water outlet orifice 31 for sprinkler 10 seen in FIG. 1. The lower surfaces 55 of each of the recessed areas 53 defines a different angle with respect to the horizontal to provide a plurality of variations in the configuration of outlet orifice 31 to create varying fan patterns of water exiting the "T"-shaped water outlet aperture 31. In the preferred embodiment of sprinkler device 10, four such horizontal slots are equally spaced about the upper end 50 of body 14, with the lower surfaces 55 of the recessed areas 53 ranging in angles with respect to the horizontal from zero to forty degrees, with the forty degree slot, when aligned with slot 34, providing a wide fan pattern and the flat zero degree surface providing a narrow stream of water from the nozzle. The manufacturer permanently aligns one of the horizontal recessed areas 53 with vertical slot 34 during construction and the user selects the sprinkler 1 having the present orifice configuration to provide the flow pattern he or she desires. By forming all four differently configured recessed areas in the sprinkler body, the cost of manufacture is reduced by obviating the need either to manufacture four differently configured sprinkler bodies or a selector mechanism.

Bearing spindle 20 is disposed within sprinkler body 14 below drive ball 51 and comprises a tubular extension 60 and a cylindrical head portion 62. Tubular extension 60 passes through the stem portion 58 in the sprinkler body 14 and the head portion 62 of bearing spindle 20 is disposed above and spaced from the horizontal seal support surface 56 in the lower portion of the sprinkler body 14. Sealing means 18, described later herein, is disposed about tubular extension 60, between surface 56 and the head portion 62 of the bearing spindle 20. A clearance of about 0.005–006 in. is provided between stem portion 58 and extension 60 to allow for free rotation of the sprinkler body 16 about bearing spindle 20.

Head portion 62 of bearing spindle 20 defines a cylindrical chamber 64 therein which is in fluid communication with the interior of tubular extension 60. A disc shaped swirl plate 66 having a depending annular side wall 67 is rigidly affixed in the upper end of head portion 62, defining the upper end of chamber 64. As best seen in FIGS. 4 and 4A, swirl plate 66 has a plurality, preferably four, equally spaced and angularly disposed ramp-like slots 68 formed therein inwardly of side wall 67 such that water passing upwardly therethrough is formed into a corresponding plurality of relatively low velocity streams of water which are caused to swirl in the direction of the slots about a central sprinkler chamber 69 defined by nozzle head 12 and sprinkler body 14 and bordered by ball track 36. The direction of flow created by slots 68 is substantially tangential to track 36. The swirling water continuously abuts cam surface 46 depending skirt 44, drives ball 51 about ball track 36, and exits chamber 69 through the nozzle outlet orifice 31. As the ball 51 is driven around track 36 by the swirling water, the ball also impacts the protruding angularly disposed cam surface 46 on skirt 44 with each pass of the ball about track 36, resulting in a slight rotation of the sprinkler body 14 and nozzle element 12 with respect to the stationary bearing spindle 22 with each such impact. The continual impacting of the ball 51 against cam surface 46 thus provides a slow constant 360° rotation of the sprinkler body and nozzle element for the even distribution of the water flowing therefrom. Cam surface 46 is preferably rounded so as to conform with the shape of the drive ball, allowing the ball to impact and roll over the surface, minimizing any deleterious effects of the repeated impacts on the sprinkler body. As sprinkler device 10 is designed to rotate only in one direction, the angular surface 45 on skirt 44 which faces generally in the direction of the path of movement of ball 51 does not function as a cam but provides a smooth flow surface for the water swirling about track 36 to prevent the turbulence which would otherwise result from an abrupt change in contour.

A pair of oppositely disposed bypass apertures 70 are disposed in the cylindrical side wall of head portion 62 of bearing spindle 20 and in the side wall 67 of the swirl plate 66 to allow a portion of the water passing through the bearing spindle 20 to bypass the swirl plate 66 and flow more directly to the outlet orifice 31 of nozzle head 12. By directing a portion of the incoming water through apertures 70, the volume of water being directed through the swirl plate 66 is reduced which slows the velocity of the water entering chamber 69 and swirling about ball track 36. Thus the speed of rotation of ball 51 is reduced, slowing the rate of rotation of the sprinkler body 14 and nozzle head 12 to a desired rate of about one to two revolutions per minute. In addition, by reducing the velocity of the water entering chamber 69 and the energy expended in rotating the ball 51, the pressure drop across the sprinkler 10 is significantly reduced, which is particularly desirable for low pressure applications.

Bearing nut 22 carries the sprinkler body 14 and includes a centrally disposed securement sleeve 72 for receiving in a press fit the lower portion of bearing spindle 20 below stem portion 58 of the sprinkler body 14. An annular bearing surface 74 is defined by the upper end of securement sleeve 72. An inner cylindrical wall portion 76 extends upwardly from and is outwardly spaced from securement sleeve 72 and an outer hexagonally shaped wall portion 78 is outwardly spaced from inner wall portion 76, terminating at its lower end in a threaded extension 80 for threaded engagement with a sprinkler line (not shown). The hexagonally shaped outer wall portion 78 is adapted to be gripped by a wrench for securement of the sprinkler 10 to the sprinkler line.

With the bearing spindle 20 so secured within sleeve 72, bearing surface 74 on sleeve 72 abuts the lower end 82 of the stem portion 58 of the sprinkler body 16. The upper end 84 of the inner wall portion 76 of bearing nut 22 terminates above the lower end of skirt portion 54 of sprinkler body 14 and below horizontal surface 56 thereof so as to define a tortuous access path indicated by arrow 86 for any foreign particle to the area of abutment of bearing surface 74 and end 82 of stem portion 58 thereby restricting the undesirable intrusion of such particles to the bearing surface 74.

A filter element 24, comprised of a cylindrical upper portion 87 and a frustoconically shaped body portion 88 having a plurality of longitudinal slits 85 therein is secured in a cavity 89 in the lower end of bearing nut 22. Filter element 24 is thus adapted to extend into the attachment fitting of a sprinkler line and prevent large particles of dirt or other foreign matter from passing into the flow of water through the sprinkler 10. A conventional rubber flow washer 90 is preferably disposed in the lower portion of bearing nut 22 above filter element 24 to restrict the volume of water flow through the sprinkler 10 to provide a uniform discharge of water from each sprinkler in the system, regardless of variations in water pressure at the individual sprinklers. An increase in pressure causes the washer 90 to deflect, reducing the size of the central aperture 92 therethrough and thus limiting the volume of water passing into the sprinkler. Accordingly, if a sprinkler line is improperly designed such that different sprinklers are subjected to different water pressures, the flow washer 90 will tend to equalize the discharge from each sprinkler to provide more uniform water coverage.

The sealing means 18 which is positioned about tubular extension 60 of bearing spindle 20 both seals the water flow from the intrusion of foreign matter and controls the bearing friction between the sprinkler body 14 and bearing spindle 20. The sealing means 18 comprises a stainless steel annular wave spring 94 which is partially disposed within a cylindrical recess 96 in the underside of the head portion 62 of spindle 20 and a plurality of particularly configured washers disposed below spring 94. Immediately below and adjacent spring 94 on extension 60 is a stainless steel washer 98, followed by a first resilient washer 100, preferably constructed of buna-n rubber, a second stainless steel washer 102, a teflon washer 104, and a second resilient washer 106 also preferably constructed of buna-n rubber. The first resilient washer 100 has zero inner clearance and fits tightly about extension 60, thereby preventing any foreign matter from entering the clearance area between the stem portion 58 of the sprinkler body 16 and tubular extension 60 of bearing spindle 20 which would create friction and interfere with the rotation of the sprinkler body 14 about extension 60. Upon rotation of the nozzle head 12 and sprinkler body 14 about bearing spindle 20, washers 106 and 104 rotate with body 14, while the remaining washers are stationary. The interface of teflon and stainless steel in washers 104 and 102 respectively provide the low friction necessary to avoid interference with the rotation of the nozzle head and body.

Each of the washers in sealing means 18 has an outer diameter approximately equal to the outer diameter of the spindle head 62 except for the teflon washer 104 which is of a reduced outer diameter to avoid any interference with the second stainless steel washer 102 along the outer edges thereof resulting from manufacturing defects, such as burrs on the outer edges of such washers, which are not uncommon in the manufacture of teflon washers. If washers 102 and 104 were of the same outer diameter and contained such defects, the seal between those washers would be broken if the defects happened to be in vertical alignment. Reducing the size of one of the teflon washers prevents such alignment and thus reduces the chance of a poor seal due to such manufacturing defects.

The recess 96 in which spring 94 is positioned is sized such that the wave portions 108 of spring 94 protrude from the recess 96 to preload the washers in compression between the spindle head 62 and the horizontal surface 56 of the sprinkler body 16. The amount of compression of spring 94 is limited by the abutment of the steel washer 98 against the lower annular end 110 of spindle head 62 about recess 96 to avoid over-stressing the spring. Wave spring 94 is designed to begin to compress further when the pressure within chamber 69 in the sprinkler body 14 reaches 15 psi. To achieve this result and the preloading of the washers in the sealing means 18, a spring 94 having a load rate of about one pound is typically employed with a line pressure of 20–30 psi. At higher pressures, a heavier spring may have to be used. It is important, however, to avoid too light a spring which will not maintain the washers comprising the sealing means 18 in a flat mating relationship. When the upward force exerted by the water pressure in chamber 69 exceeds the spring load, the sprinkler body 52 is moved slightly upwardly on bearing spindle 20, further compressing spring 94. At such time, spring 94 no longer contributes to the bearing friction between rotating and stationary elements. The bearing friction is solely a function of the water pressure and the effective area on the washers in the sealing means 18 against which the force of the water acts. Further, as the sprinkler body 52 is moved upwardly off bearing surface 74 on sleeve 72, a free running clearance between the sprinkler body and bearing nut 22 is provided. A centrally disposed annular recess 111 is provided in the seal support surface 56 of sprinkler body 16 to receive and thus center washer 106 with respect to extension 60 of bearing spindle 20.

With the exception of the sealing means 18, flow washer 92 and the stainless steel drive ball 51, each of the elements comprising sprinkler device 10, are preferably constructed of a plastic material, but could also be constructed of metal.

In use, water passes under line pressure through the longitudinal slits 85 in the filter element 24, through the central aperture 92 in the flow washer 90 and into the tubular extension 60 of bearing spindle 22 to the head portion 62 thereof. A portion of the water passing into the head portion 62 flows through bypass apertures 70, upwardly into chamber 69 and exists the sprinkler 10 through outlet orifice 31. The remainder of the water entering the head portion 62 passes through the angularly disposed slots 68 in swirl plate 66, causing such water to follow a swirling path within chamber 69 about ball track 36, driving ball 51 about track 36 as described earlier herein to effect rotation of the sprinkler body 14 and nozzle head 12. The swirling water then mixes with the water bypassing the swirl plate 66 in the upper portion of nozzle element 12 and the combined flow exits the nozzle outlet orifice 31 in the preset spray configuration.

Because no energy is required to lift the ball 51 to effect impact with contact surface 46, as is the case with conventional ball drive sprinklers using a rising vortex of fluid flow, the aforesaid configuration requires little energy to drive ball 51 about track 36 and effect rotation of the sprinkler body and nozzle element, allowing a portion of the water entering the sprinklers to be passed directly to the nozzle element, bypassing the swirl plate 66. Thus, the pressure drop across the sprinkler is greatly reduced as compared to conventional ball drive sprinklers, as is the necessary size of the driving ball and ball chamber, significantly reducing the wear which results from the continual high speed vertical movement of the more massive drive balls within the prior art sprinkler heads. By way of example, the stainless steel drive ball is about 5/16 in. in diameter, track 36 is about 9/16 in. in diameter and the entire sprinkler device 10 is only about ¾ in. in diameter and is operable at pressures as low as 20 psi. Typically, sprinkler device 10 will spray about 1.2 gallons per minute over a thirty foot radius at 30 psi, and the ball drive 16 will rotate the sprinkler body and nozzle element at about one to two r.p.m., depending on the horizontal slot 53 used to define the water outlet orifice 31.

By varying the size of the bypass apertures 70, the desired speed of rotation can be obtained over a wide range of line pressures and outlet orifice sizes without adversely affecting the operation of the sprinkler device. If a larger nozzle exit orifice is desired for a larger volume spray, the size of bypass orifices 70 can be enlarged to maintain the desired rotational speed of the nozzle. When encountering greater line pressures, the size of bypass apertures 70 can again be increased to maintain the desired slow rate of rotation of the sprinkler body and nozzle element. Conversely, at low pressures or with very small exit orifices for a fine spray, the size of apertures 70 would be reduced.

The force generated by the water spraying from nozzle outlet orifice 31 creates an uneven load on the sprinkler body 14 with respect to the bearing spindle 20. The preloading of the washers 98-106 by wave spring 94 maintains the washers in intimate parallel contact even when the sprinkler body 14 and bearing spindle 20 are urged out of their parallel disposition by the force of the water exiting orifice 31. As a result, dirt or other foreign matter is prevented from passing through the seal washers into the area between the bearing spindle 20 and sprinkler body 14 which would adversely affect the free rotation of the sprinkler body with respect to the bearing spindle. Foreign matter is prevented from passing into this critical area from below due to wave spring 94 urging the lower end 82 of the sprinkler body against bearing surface 74 of bearing nut 22 when water is not flowing through the sprinkler 10 under sufficient pressure to compress spring 94 as described above and by virtue of the tortuous external access path to bearing surface 74 defined by the wall portions 76 and 78 of bearing nut 22 and the depending skirt portion 54 of the sprinkler body 14.

THE SECOND EMBODIMENT

The second embodiment of the invention, illustrated in FIGS. 6–12, provides a highly efficient, low volume sprinkler device particularly adapted for use as a replacement or retrofit for drip irrigation and convert the spot coverage of drip irrigation to full soil coverage while maintaining the very low water flows found in drip irrigation. The sprinkler device 200 of the second embodiment generally comprises a nozzle head 202, cap 204, nozzle diffuser/deflector 206, bearing spindle 208, bearing guard 210, sealing means 212, ball drive 214, a sprinkler body 215 including an upper housing 216 and lower housing 218, a swirl plate 217 and filter element 220. Except for the sealing means 218 and drive ball 266, each of the elements comprising sprinkler 200 is preferably constructed of an engineering grade plastic material such as that marketed under the name Delrin by DuPont.

The nozzle head 202 of sprinkler 200 is of integral construction and defines a central channel 222 extending axially therethrough, an annular chamber 224 disposed about channel 222, an annular concave external gripping surface 226, an internal upwardly extending cylindrical sleeve 228 disposed about channel 222 and a plurality of upwardly inclined and differently sized water outlet slots 230 disposed in the lower inclined surface 232 of nozzle head 202. Four such slots are provided in the preferred embodiment illustrated in the drawings. Slots 230 are equally spaced about surface 232 of nozzle head 202 and are preferably semicircular in cross-section with their major transverse axes lying adjacent the inclined upper surface 234 of bearing guard 210. Slots 230 range in transverse dimension adjacent surface 234 from about 0.028 in. to 0.048 in. across. One of slots 230 is adapted to communicate with central channel 222 through aperture 241 in the wall of the bearing spindle 208 and, when aligned with aperture 241, cooperate with a vertical slot 233 in the correspondingly inclined upper surface 234 of bearing guard 210 to define the water exit orifice 236 for sprinkler 200. By providing four differently sized slots 230 in nozzle head 202 which can be selectively aligned with vertical slot 233, sprinkler device 200 is provided with four available differently sized water exit orifices to vary the volume of flow through the sprinkler as desired.

Nozzle head 202, cylindrical cap 204 and bearing guard 210 are carried by the centrally disposed hollow bearing spindle 208 which is rotatably mounted within the upper housing 216 of sprinkler 200. Cap 204 is rigidly affixed to the upper portion of spindle 208 and defines an annular channel 238 in the lower portion thereof and a concave thumb pressing surface 240 in the upper end thereof. Spindle 208 extends through channel 222 in nozzle head 202 so as to slidably and rotatably mount the nozzle head on the spindle adjacent and immediately above bearing guard 210 and below cap 204 such that by rotating the nozzle head 202 about the bearing spindle 208, one of the four water outlet slots 230 in the nozzle head can be selectively brought into alignment with aperture 241 in the bearing spindle and slot 233 in the bearing guard 210, enabling water to pass from the interior of the spindle, outwardly through the aligned slots 230 and 233 defining the sprinkler exit orifice 236. Also, the nozzle head may be raised off of surface 234 of the bearing guard 210 allowing for a free flow of water to be discharged, clearing out any foreign matter from the slots 230 and 233 without the need for tools or other instruments which could damage the nozzle head and/or bearing guard. Bearing guard 210 defines an inner wall portion 242 and an outer depending flared wall portion 244 and is rigidly affixed to the bearing spindle 208 adjacent the underside of nozzle head 202. A coil spring 246 is disposed within and bears against the opposite end walls of channels 224 and 238 in nozzle element 202 and cap 204 respectively.

To assist the user in aligning and maintaining alignment of the desired sized water outlet slot 230 with aperture 241 and slot 233 and thus obtaining the desired water flow volume from sprinkler 200, alignment means are provided in the inclined abutting surfaces 232 and 234 of the nozzle head 202 and bearing guard 210. In the preferred embodiment of sprinkler 200, a plurality of indexing balls 255 corresponding to the number of fluid outlet slots 230 in the nozzle head are mounted in the upper surface 234 of bearing guard 210 such that they protrude therefrom. A corresponding plurality of detents 257 are provided in the lower surface 232 of nozzle head 202 which are adapted to receive the protruding portions of the balls 255 when one of slots 230 is aligned with aperture 241 in the spindle 208. Upon placing one's thumb on the upper concave surface 240 of cap 204 and fingers about the conical gripping surface 226 of nozzle head 202, the nozzle element can be pulled upwardly toward cap 204, compressing spring 246 with the lower end of the cap fitting within the upper end of the annular chamber 224 in the nozzle head. Upon raising the nozzle element, detents 257 are disengaged from the indexing balls 255 in the underside of the nozzle head 202. The raised nozzle head 202 can then be rotated about spindle 208 to align the desired sized fluid outlet slot 230 therein with the aperture 241 in the bearing spindle 208 and the vertical slot 233 in the bearing guard 210. Upon releasing the nozzle head, coil spring 246 urges the nozzle head back to its lowered operative position against the bearing guard, whereupon the alignment balls 255 are received in the aligned detents 257 to prevent further rotation of the nozzle head and misalignment of the desired fluid outlet slot 230. By raising the nozzle head 202 on spindle 208, the fluid outlet slots 230 are lifted off of the upper surface 234 on the bearing guard 210 which allows water to flush through the sprinkler and nozzle head, removing any foreign matter from the outlet slots 230 which would otherwise interfere with the free flow of water therethrough.

Figures 6, 7, 8, 9, 10, 11, 12:
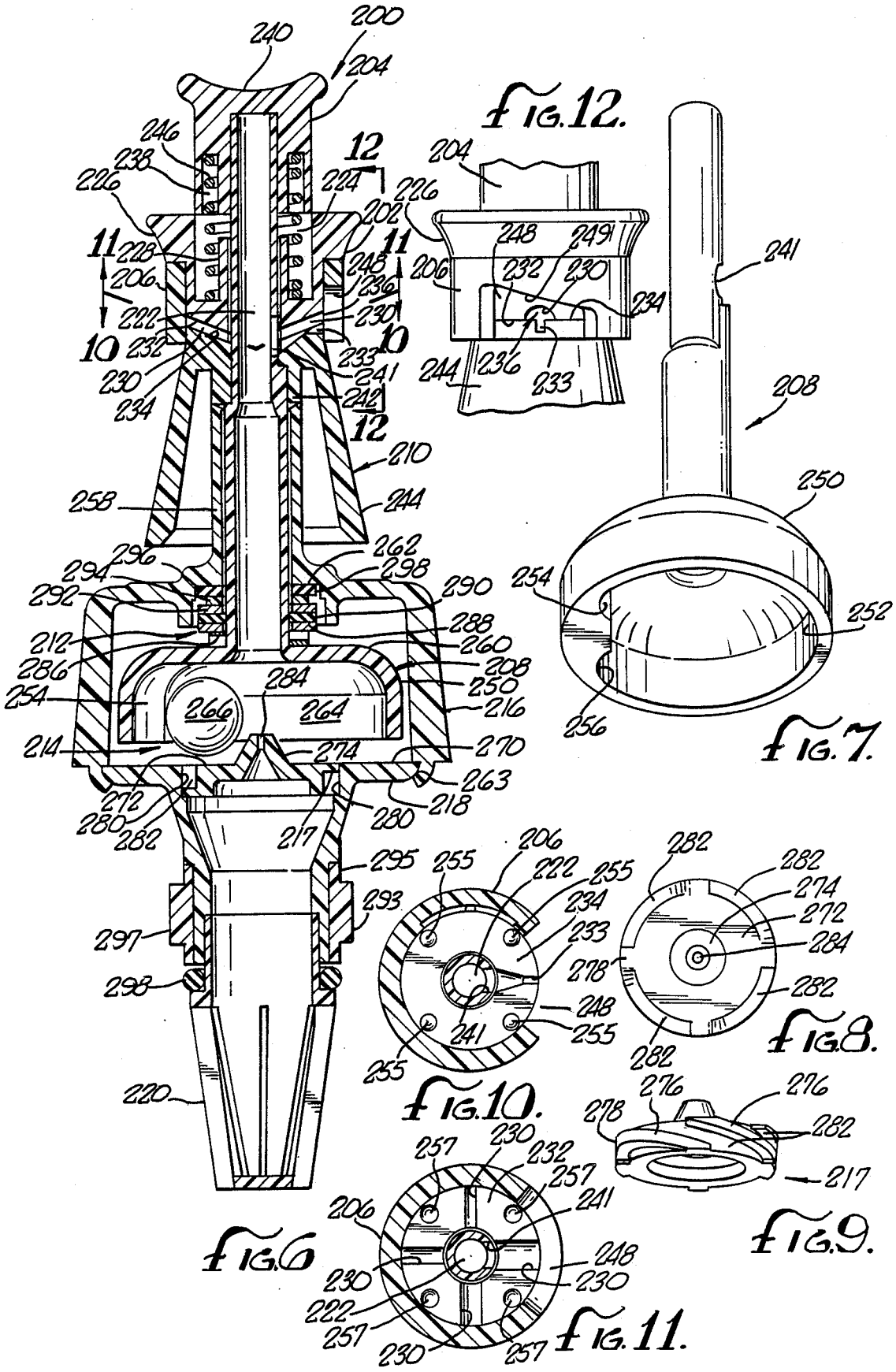
FIG. 6 is a sectional side view of a second embodiment of a sprinkler device of the present invention.
FIG. 7 is a perspective view of the bearing spindle in the second embodiment.
FIG. 8 is a top view of the swirl plate of the second embodiment.
FIG. 9 is a perspective view of the swirl plate of the second embodiment.
FIG. 10 is a bottom view of the underside of the nozzle head of the second embodiment.
FIG. 11 is a top view of the bearing guard of the second embodiment.
FIG. 12 is a partial side view of the second embodiment illustrating the sprinkler exit orifice and nozzle deflector of the second embodiment.
Figure 13:
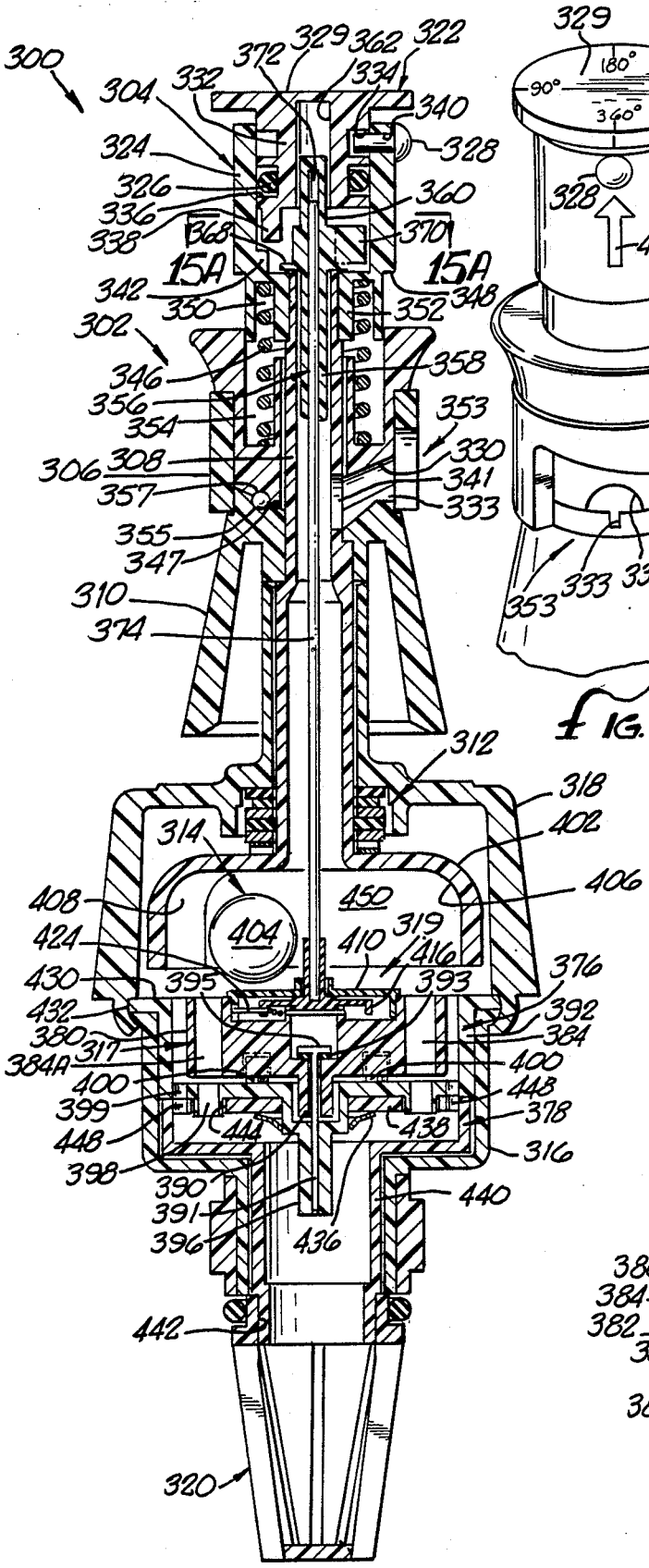
FIG. 13 is a sectional side view of a third embodiment of a sprinkler device of the present invention.

An annular nozzle diffuser/deflector 206, shown in FIG. 12, is rotatably mounted about the nozzle head 202 below the concave gripping surface 226 thereon. The diffuser/deflector 206 has an elongated opening 248 therein which has an inclined upper deflector surface 249 adapted to be moved across the upper portion of the sprinkler exit orifice 236. By turning the diffuser/deflector 206 about nozzle element 202, the inclined upper surface 249 of opening 248 can be disposed a desired amount below or above the upper surface of exit orifice 236 to diffuse and deflect the water passing therethrough. By varying the extent to which surface 249 covers the exit orifice 236, the degree to which the exiting water is diffused and deflected can be adjusted to vary the diameter of area of water coverage and the size of the water droplets comprising the spray. A slight intrusion of surface 249 into the spray will diffuse the water, creating smaller droplets without affecting the trajectory or diameter of the spray. This allows the sprinkler to provide an efficient spray at low pressure whereas otherwise, the droplets would be too large and would not land sufficiently close to the sprinkler to provide the desired uniform coverage. By increasing the intrusion of the inclined surface 249 into the spray, the trajectory and thus the diameter of coverage of the sprinkler can be reduced to the extent desired. It should be noted that while not shown, a diffuser/deflector could be employed in the first embodiment of the invention. Such a device would replace cap 48, be rotatably mounted in the upper end of the nozzle head 12, extend about the upper end of the nozzle head and define a depending angularly disposed surface which would operate and function in the same manner as surface 249 in this second embodiment.

The lower portion of bearing spindle 208 defines an inverted cup 250, the interior surface thereof defining ball track 252 and a pair of angularly disposed slightly curved protruding surfaces 254 and 256. Surface 254 defines a ball contact cam surface, and surface 256 provides for uninterrupted continuous fluid flow surface about track 256 as described with respect to track 36 and surfaces 46 and 45 in the prior embodiment. Upper housing 216 extends about cup 250 and includes a stem portion 258 extending parallel to and spaced about 0.005–0.006 in. from spindle 208 to allow for free rotation of bearing spindle 208 about the stem portion 258 of the upper housing. Sealing means 212 is disposed between the outer upper surface 260 of cup 250 and the interior upper surface 262 of housing 216. Lower sprinkler housing 218 is secured to the upper housing 216 at 263 and defines a central chamber 264 therebetween in which cup 250 and drive ball 266 are disposed.

A swirl plate 217, shown in detail in FIGS. 8 and 9, are secured in the center portion of the upper surface 270 of the lower housing 218 below the central portion of cup 250. Swirl plate 217 includes a disc portion 272, a centrally disposed frustoconical extension 274 extending upwardly therefrom, and a plurality, preferably four, of equally spaced separate lead threads 276 inclined upwardly in the outer perimeter wall 278 of disc portion 272. The outer perimeter wall 278 of swirl plate 217 abuts and is permanently affixed to a cylindrical wall 280 formed in the interior of the lower sprinkler housing 218 to secure the swirl plate 217 in place. So secured, threads 276 define a corresponding plurality of upwardly inclined slots 282 to separate the water passing through swirl plate 217 into four separate low velocity water streams which propel the drive ball 266 about track 252, around the frustoconical extension 274 on the swirl plate. The revolving ball effects rotation of the bearing spindle 208, nozzle head 202, bearing guard 210 and cap 240 with respect to the upper and lower housings 216 and 218 by repeatedly impacting the protruding ball contact cam surface 254 in cup 250 in the same manner in which ball 51 impacted cam surface 46 to drive the nozzle head 12 and body 14 about the bearing spindle 18 in the prior embodiment. A bypass orifice 284 can be provided in frustoconical extension 274 of the swirl plate 268 for high volume applications to serve the same function as bypass apertures 70 in the prior embodiment.

The particular configuration of slots 282 in swirl plate 268 which provide four separate driving streams of water and the relatively tight ball track 252 defined by the interior of cup 250 and the frustoconical extension 274 on the swirl plate provides an extremely efficient, low energy ball drive mechanism, allowing ball 266 to be driven about the track and rotate the nozzle element with a very low volume of water flowing therethrough. The flow volume through sprinkler 200 is approximately eight to thirty gallons per hour, depending on the size of slot 230 aligned with aperture 241 in sprinkle 208. In addition, the size of drive ball 266 can be reduced to about 9/32 in. in diameter and provide the desired slow 360° rotation or the nozzle head of about 0.75 to 1 revolutions per minute, depending on the size of aligned slot 230, while spraying an area of about eighteen feet in radius.

Sealing means 212 is virtually identical to sealing means 18 in the prior embodiment, but is inverted with respect thereto. Sealing means 212 comprises a wave spring 286 disposed on the upper surface 260 of cup 250 about spindle 208, a first stainless steel washer 288, a first resilient washer 290, the inner diameter thereof being in engagement with bearing spindle 208 to prevent foreign matter from passing therebetween, a second stainless steel washer 292, a teflon washer 294 of reduced outer diameter, and a second resilient washer 296 disposed within a recess 298 in upper housing 216. Sealing means 212 functions in the same manner as sealing means 18 in the prior embodiment to control the friction between bearing spindle 208 and the elements rotating thereon and to prevent the intrusion of foreign matter therebetween. However, due to the reduced flow through sprinkler 200, wave spring 286 is designed to compress upon a pressure build up within the sprinkler of about 10 psi as opposed to 15 psi for wave spring 94 in the prior embodiment. Accordingly, when operating with a line pressure of about 20–30 psi, spring 286 should have a load rate of about 2–2.5 lbs. If the line pressure were higher, a heavier spring would be employed.

Sprinkler 200 is also preferably provided with a filter element 220 similar to filter 24 in the prior embodiment and a quick disconnect 293 for detachably securing the sprinkler 200 to the sprinkler line to reduce and simplify maintenance. The quick disconnect 293 is comprised of an annular collar 295 disposed about the lower portion of lower housing 218 and a pair of lugs 297 oppositely disposed on collar 295 and projecting outwardly therefrom which are adapted to be received in a bayonet fitting within L-shaped slots (not shown) in the end of the water line to which the sprinkler 200 is to be secured. An 0-ring 298 is provided between the filter 220 and lower housing 218 which bears against the interior surface of the water line to prevent water flow from passing upwardly outside of the filter element 220. The filter 200 is secured to the water line by merely aligning the lugs 297 with the slots in the end of the water line, pressing the sprinkler downwardly and turning the sprinkler 90° with respect to the water line thereby securing the sprinkler in place for use.

THE THIRD EMBODIMENT

The third embodiment of the present invention, illustrated in FIGS. 13–19 is adapted for residential use by home owners or renters in a conventional sprinkler system to provide an energy and water efficient, low pressure continuously reversing adjustable spray. Means are provided for varying the sprinkler's arc of throw and the size of the water outlet orifice to provide a relatively constant volume of flow through the sprinkler regardless of the prescribed degrees of arc to which the sprinkler is set.

The third embodiment of the sprinkler device 300 is similar in many respects to the sprinkler device 200 of the second embodiment and includes many of the same elements. Sprinkler 300 is designed to be about the same size as sprinkler 200 so that certain components may be interchangeable. The major difference between sprinkler 300 and sprinkler 200 is that sprinkler 300 is designed to handle a significantly greater flow volume therethrough and includes means for presetting a prescribed arc of throw for the sprinkler and for effecting a continuous rotating and counter-rotating movement back and forth across a prescribed arc of throw ranging from about 60° to 360°. Sprinkler device 300 generally comprises a nozzle head 302, a cap assembly 304, a nozzle diffuser/deflector 306, bearing spindle 308, bearing guard 310, sealing means 312, ball drive 314, lower housing 316, swirl plate 317, upper housing 318, clutch assembly 319 and filter element 320.

The nozzle head 302, nozzle deflector 306, bearing spindle 308, bearing guard 310, sealing means 312, ball drive 314, upper housing 318, and filter element 320 are each of the same configuration and operate in the same manner as the corresponding elements 202, 206, 208, 210, 212, 214, 218 and 220 in the second embodiment of the invention. Accordingly, to avoid repetition, only the elements in the sprinkler device 300 which differ from those in the second embodiment will be described herein in detail.

The cap assembly 304 and swirl plate 317, unlike cap 204 and swirl plate 217 in the prior embodiment, are operatively connected in sprinkler device 300 to provide a continuous reversing rotational spray which is readily adjustable to prescribe the desired arc of throw for the sprinkler 300.

Cap assembly 304 is comprised of a direction control cap 322, a cylindrical trip collar 324, an o-ring 326 and a lock rivet 328. The direction control cap 322 defines a flat upper head portion 329 and a substantially cylindrical extension 332 depending therefrom. Extension 332 defines a first annular recess 334 adapted to receive the extended end of lock rivet 328, a second annular recess 336 adapted to receive o-ring 326 and a depending dog 338. Trip collar 324 is disposed about the cylindrical extension 332 of cap 322 and bears against o-ring 326 to prevent fluid flow or the passage of foreign matter therebetween. Trip collar 324 has an aperture 340 extending through the upper portion thereof for the passage of lock rivet 328 therethrough and defines an inwardly projecting radial stop 342 disposed below dog 338 on the direction control cap 322. The lock rivet 328 secures the direction control cap 322 to the trip collar 324 while allowing the cap to be manually rotated with respect to the trip collar for the purpose of varying the arcuate separation between the depending dog 338 on the direction control cap 322 and the radial stop 342 on the trip collar 324 for reasons to be explained. Other means for securing the trip cap to the trip collar while allowing such relative rotation, such as a split locking ring, could be employed in lieu of lock rivet 328.

The lower portion of trip collar 324 is configured similar to the lower portion of cap 204 in the second embodiment and cooperates in the same manner with the nozzle head and bearing guard for selective alignment of the nozzle head with respect to the bearing spindle and bearing guard to obtain the desired sized water exit orifice. Trip collar 324 defines an annular external shoulder 348, an annular channel 350 open at its lower end and a cylindrical inner wall 352 engaging the upper end of bearing spindle 308 such that the direction control cap 322 and trip collar 324 comprising cap assembly 304 are carried by and rotatable with bearing spindle 308. The lower portion of trip collar 324 is disposed immediately above an open channel 354 in the nozzle head 302 and a coil spring 346 is disposed within and bears against the opposite end walls of channels 350 and 354 in the trip collar 324 and nozzle head 302 respectively, so that the nozzle head 302 can be raised upwardly about the lower portion of trip collar 324, rotated with respect thereto for alignment of one of the differently sized semi-circular inclined radial fluid outlet slots 330 in the underside of nozzle element 302, with the aperture 341 in the side of the upper portion of bearing spindle 308 and with the vertical slot 333 in the upper inclined surface 347 of bearing guard 310. The nozzle head is then released, whereupon spring 346 returns the nozzle head to its lower operative position in a mating abutment with the inclined upper surface of the bearing guard 310 and is held in proper alignment by the protrusion of indexing balls 355 into detents 357 in the manner described with respect to the second embodiment. The upward movement of nozzle head 302 about the lower portion of trip collar 324 is limited by shoulder 348 on trip collar 324. It should be noted that in this embodiment, however, three differently sized fluid outlet slots 330 are shown as opposed to four such slots 230 in the second embodiment, and thus three indexing balls 355 and detents 357 are employed as opposed to the four such balls and detents shown with the prior embodiment. The number of differently sized fluid outlet slots is merely a matter of choice and does not otherwise affect the operation or function of the device.

A trip member 356 extends between the direction control cap 322 and the upper portion of bearing spindle 308 and is spaced therefrom to allow rotation of the cap and bearing spindle about trip member 356. The trip member 356 comprises a lower cylindrical portion 358 extending interiorly of the upper portion of bearing spindle 308, an upper cylindrical portion 360 extending into a channel 362 in the direction control cap 322, and an intermediary portion 364. Channel 362 in cap 322 extends beyond the upper end of the trip member 356 to accommodate the slight upward movement of the trip member during use caused by the water pressure within the sprinkler 300 which compresses slightly sealing means 312 and raises the bearing spindle 308 and trip member 356. The intermediary portion 364 of the trip member 356 includes a horizontal radial flange 368 disposed over the upper end of bearing spindle 308 and a radially extending trip stop 370. Trip stop 370 is disposed such that upon rotation of the cap assembly 304 about and with respect to trip member 356, either the radial stop 342 on trip collar 324 or the depending dog 338 on direction control cap 322 will abut trip stop 370, depending on the direction of rotation of the cap assembly 304. As will be shown, the repeated alternating impacting of radial stop 342 and dog 338 on stop 370 causes the continual reciprocating movement of the sprinkler nozzle head 302 back and forth over the prescribed arc of throw. Trip member 356 also includes an elongated rectangular or square channel 372 therein adapted to receive in a sliding fit a similarly configured direction control shaft 374 preferably constructed of stainless steel no. 302.

Direction control shaft 374 extends downwardly from trip member 356 and through the central axis of bearing spindle 308 to a clutch assembly 319 mounted in the upper end of swirl plate 317 to mechanically couple the direction control shaft 356 to the swirl plate. The swirl plate is mounted within a swirl plate housing 376 disposed above a bypass flow selector 378 within the lower sprinkler housing 316.

The swirl plate 317, best seen in FIGS. 16, 17 and 19, defines four segmented cylindrical outer wall portions 380, a central substantially square body portion 382, and four equally spaced "V" shaped water deflection ribs 384 which extend between the body portion 382 and segmented wall portions 380 and taper outwardly from the lower surface 387 of the swirl plate 317 to the upper surface thereof such that each rib defines oppositely facing deflection surfaces 384A and 384B. A plurality of elongated arcuate slots 386 are disposed in the underside 387 of body portion 382. A cylindrical recess 388 is provided in the upper surface of the swirl plate 317 and a depending stem portion 390 extends downwardly from the underside 387 of the swirl plate 17.

The swirl plate housing 376 in which swirl plate 317 is mounted defines a cylindrical outer wall portion 392 disposed about and spaced from the segmented walls 380 of the swirl plate, a bottom wall 394 and a depending stem portion 396. A securement rivet 391 extends through and is in frictional engagement with the stem portion 390 of the swirl plate and stem portion 396 of the swirl plate housing 376 to secure the swirl plate in the housing. A washer 393 is disposed below the head portion 395 of rivet 391 to prevent any fluid flow from passing therebetween.

The bottom wall 394 of the swirl plate housing 376 has four equally spaced apertures 398 therein adapted to be aligned adjacent and below one side of each of the "V" shaped deflection ribs 384 in the swirl plate 317. A plurality of water bypass apertures 399 are disposed radially outwardly from apertures 398 in bottom wall 394 to provide a fluid flow path which bypasses the swirl plate 317. Four upstanding indexing members 400 are also provided on the bottom wall 394 of the swirl plate housing 376 which extend into the elongated slots 386 in the underside of the swirl plate 317 such that the swirl plate can be rotated with respect to the housing 376 a distance limited by the movement of the indexing members 400 within the elongated slots 386.

Water passing upwardly to the swirl plate 317 through apertures 398 in the swirl plate housing 376 will abut the "V" shaped deflection ribs 384 of the swirl plate. Depending on the orientation of the swirl plate 317 within the housing 376, each of the deflection ribs 384 will either be disposed slightly to the right or to the left of one of apertures 398, such that the water passing through apertures 398 will strike either tapered deflection surface 394A or 394B of each of ribs 394. The movement of the swirl plate 317 in the swirl plate housing 376 is restricted by indexing members 400 in elongated slots 386 such that each of the deflection ribs 384 can collectively be moved back and forth over the apertures 398 in the swirl plate housing 376 to alternatively collectively position either surfaces 384A or 384B in the paths of incoming water flowing through apertures 398 in the swirl plate 317. If the incoming water impacts surfaces 394A, the water will cause a slight clockwise rotation of the swirl plate within housing 376 and be directed by deflection surfaces 394A in an upwardly swirling clockwise direction between the segmented wall portions 380 and the body portion 382 of the swirl plate 317 into the inverted cup 402 defined by the lower portion of the bearing spindle 308. The swirling water there propels the drive ball 404 about the drive track 406 and against the protruding angularly disposed protruding cam surface 408 on cup 402 to effect a clockwise rotation of the bearing spindle 308 and the elements carried thereby, including nozzle element 302, as described with respect to the second embodiment of the invention above. Conversely, if the swirl plate were positioned such that the incoming water were to strike the oppositely disposed surfaces 384B of the deflection ribs, the swirl plate would be caused to undergo a slight counter-clockwise rotation within the swirl plate housing 376 which in turn would similarly effect a counter-clockwise rotation of the drive ball 404 about ball track 406 whereupon the ball would abut the angularly disposed protruding cam surface 409 on cup 402 and thereby effect counter-clockwise rotation of the nozzle element 302.

A clutch assembly 319 mechanically couples the swirl plate 317 to trip member 356 by means of a direction control shaft 374. The clutch assembly 319 is best seen in FIG. 17 and comprises an upper cylindrical clutch disc member 410, a lower cylindrical clutch disc member 416 and a coil spring 424. The lower end of shaft 374 extends slidably through a centrally disposed aperture 411 in the upper disc member 410 and is rigidly secured to the lower disc member 416 in a tubular extension 418. Upper disc member 410 has a depending annular wall 412 extending about a portion of the perimeter thereof. Wall 412 defines a pair of inclined camming surfaces 414 at its extended ends. The lower disc member 416 is disposed interiorly of annular wall 412 and defines an annular depending perimeter flange 420 having a notch 421 cut therein. Notch 421 is adapted to receive the outer radially extending end 422 of a concentric coil spring 424 disposed within the cylindrical recess 388 in the upper end of swirl plate 317. Spring 424 is disposed within recess 388 about a central slotted post 426 with the inner end 428 of the spring 424 being bent radially inwardly through the slotted post 426 thereby mechanically joining the inner and outer ends of coil spring 424 to the swirl plate 317 and the lower disc member 416 respectively. The annular depending wall 412 of the upper disc member 410 of the clutch assembly fits within and bears lightly against the wall portion defining the cylindrical recess 388 in the swirl plate 317. As a result of the securement of the direction control shaft 374 to the swirl plate 317 through spring 424, rotation of the shaft is imparted to the swirl plate. Accordingly, as will be further described herein in discussing the operation of sprinkler 300, the bearing spindle 308, nozzle head 302, cap 322, trip collar 324, bearing guard 310 and nozzle diffuser/deflector 306 are rotated by ball drive 314 until either the depending dog 338 on the rotating cap 322 or the stop 342 on the rotating trip collar 324 impact the radially projecting trip stop 370 on the stationary trip member 356. The force of the impact is transmitted down to the lower disc member 416 in the clutch assembly 319 by the direction control shaft 374 extending therebetween which applies a load to the clutch spring 424. This load is in turn transmitted through the center coil portion of the spring to the swirl plate 317. The force of the load, together with the stored potential energy in the spring 424 generated by the initial slight rotation of the swirl plate caused by the water passing therethrough, exceeds the force generated by the upwardly moving water on the deflection ribs 384 on the swirl plate, causing the swirl plate to counter-rotate rapidly through the incoming water. This counter-rotation moves the deflection ribs across apertures 398 in the swirl plate housing 396 to bring the oppositely facing surfaces 384A or B into the path of the incoming water and thereby reverse the direction of swirl and thus the direction of rotation of the bearing spindle and nozzle head. In this manner a continuously reversing spray through the nozzle head is achieved.

The amount of rotation of the swirl plate is limited by the lengths of the elongated slots 386 on the underside of the swirl plate into which the indexing members 400 on the immovable swirl plate housing 376 extend. Accordingly, further rotation of the shaft 374 beyond the point at which the indexing members 400 abut the ends of slots 386, causes corresponding rotation of the lower clutch disc 416 rigidly affixed to the shaft 374. As disc 416 continues to rotate, the outer radially extending end 422 of spring 424, which is held within notch 421 in the lower disc 416, is brought into contact with one of the camming surfaces 414 on the stationary upper disc 410. As the spring end 422 rides downwardly along the camming surface, it is forced out of notch 421, disengaging the swirl plate 317 from the rotating shaft 374. Thus, if one were to manually rotate the nozzle head 302 and cap assembly 304 about bearing spindle 308, the depending dog 338 on the direction control cap 322 or the stop 342 on the trip collar would abut the stop 370 on the trip member 356 and effect rotation thereof and of shaft 374 and the lower disc member 416 in the clutch assembly. If the spring were not disengaged by the clutch assembly it would quickly be overstressed and damaged. By disconnecting one end of the clutch spring 424, the nozzle head 302, bearing spindle 308, bearing guard 310, cap assembly 304, direction control shaft 374 and trip member 356 can all rotate freely with respect to the stationary sprinkler housings 316 and 318, swirl plate 317, swirl plate housing 376, flow selector 378 and filter element 320. As soon as such manual rotation ceases and the slow rotation generated by the ball drive 314 is initiated, rotation of the shaft 374 by trip member 356 would realign the notch 421 on the lower clutch disc 416 with the radially projecting spring end 422. As the horizontal plane of spring end 422 in the relaxed position is above the lower horizontal surface of perimeter flange 420 on lower clutch disc 416, spring end 422 will snap back into notch 421 upon such realignment, recoupling the direction control shaft to the swirl plate without affecting the preset arc of throw of the sprinkler.

The swirl plate housing 376 within which the swirl plate 317 rests is disposed within the lower sprinkler housing 316 and is rigidly secured to the lower and upper sprinkler housings 316 and 318 by an annular lip 430 secured therebetween at 432. A flow selector 378 is rotatably mounted within the lower housing 316 below and adjacent swirl plate housing 376 and is held thereagainst by a push nut 436. Flow selector 378 defines an upper horizontal wall 438 disposed adjacent the underside of the swirl plate housing 376 and has a depending shaft portion 440 which is secured to the filter element 320 at 442 such that manual rotation of the filter element corresponding rotates the flow selector. The upper horizontal wall 438 of the flow selector has a first plurality of elongated arcuate apertures 444 therein adapted for continuous fluid communication with the swirl plate 317 through the apertures 398 in the underside of the swirl plate housing 376, and a second plurality of outer bypass apertures 448 which are spaced outwardly from apertures 444 and are adapted to selectively communicate with the bypass apertures 399 in the swirl plate housing to direct water passing therethrough directly into the central sprinkler chamber 450, bypassing the swirl plate.

By rotating the filter element 320, the bypass apertures 448 can either be aligned with the bypass apertures 399 in the swirl plate housing to bypass a portion of the water passing through the sprinkler device 300 about the swirl plate 317 (bypass condition) or, misaligned with apertures 399 such that the bypass apertures 448 in the flow selector are sealed by the underside of the swirl plate housing 376 and all of the water passing through the sprinkler device 300 is directed through the swirl plate (non-bypass condition). The bypass condition is generally employed for use with the larger nozzle orifices in the nozzle head 302 as described earlier herein with respect to the second embodiment of the invention. The elongated arcuate configuration of apertures 444 in the flow selector provide continuous fluid communication with apertures 398 in the swirl plate housing, regardless of whether the flow selector 378 is in the bypass or the non-bypass condition. Any suitable means, such as depending perimeter flanges 398' disposed about apertures 398 which project into the elongated arcuate apertures 444, can be employed to limit the relative movement of the flow selector 378 with respect to the swirl plate housing 376 to maintain continuous fluid communication between apertures 398 and 444 as the flow selector is moved between the bypass and non-bypass condition.

In use, the user first presets the desired arc of throw by manually rotating the direction control cap 322 with respect to the trip collar 324 to arcuately space the depending dog 338 on the direction control cap the desired number of degrees from the radial stop 342 on the trip collar. As the direction control cap 322 and trip collar 324 rotate and counter rotate during use with respect to the radial stop 370 on trip member 356, this arcuate spacing between dog 338 and stop 342 correspond to the arc of throw of the sprinkler. As this arcuate spacing cannot be viewed from the exterior of the sprinkler device 300, alignment indicia are provided on the trip cap and the trip collar which correspond to different arcs of throw; i.e., 360°, 270°, 180° and 90°. To allow for the necessary rotation and counter-rotation of the swirl plate, a free travel of the cap assembly and nozzle head of about 60° is required, thus establishing a minimum arc of throw of about 60°. By aligning an indicator 451 such as an imprinted arrow on the trip collar with one of the selected markings or color codings provided on the direction control cap, the desired arc of throw is obtained. The user can then select which size nozzle orifice to use with the selected arc of throw. The larger the selected nozzle orifice, the greater the volume of flow is through the sprinkler. When different arcs of throw are used on a plurality of different sprinklers 300 in a given sprinkler line to provide a relatively constant volume of spray over the entire area of coverage, the larger orifices are used with the larger arcs of throw and the smaller orifices are used with the smaller arcs. The nozzle orifice adjustment is obtained as described earlier herein by merely raising the nozzle head 302 with respect to the nozzle guard 310 and rotating the nozzle head to align the desired sized outlet slot 330 therein with the aperture 341 in the side bearing spindle 308 and the vertical slot 333 in the upper inclined surface of the bearing guard 310. As will be further discussed herein, depending on the size of the orifice selected and the desired volume of flow through the sprinkler 300, the filter is then rotated to bring the flow selector 378 either into a bypass condition or to direct all of the fluid flow through the swirl plate 317. The diffuser/deflector 306 is utilized in the same manner as in the prior embodiment to regulate the quality and range of the spray.

In operation, water passes upwardly through the filter element 320, through apertures 448 and/or 444 in the flow selector 378, depending on the orientation thereof with respect to the swirl plate housing 376, and about and/or to the swirl plate 317. The water passing about the swirl plate through bypass apertures 448 and 399 in the flow selector 378 and the swirl plate housing 376 flows upwardly through central chamber 450 in the upper housing, through the bearing spindle 308 and exits the sprinkler device through the water exit orifice 353 defined by fluid outlet slot 330 in the nozzle element in alignment with the aperture 341 in the bearing spindle 308 and the vertical slot 333 in the upper surface of the bearing guard 310. The water passing to the swirl plate strikes either tapered surface 384A or 384B on the water deflection ribs 384, depending on the angular disposition of the ribs with respect to orifices 398 in the swirl plate housing 376 at the time the water flow is activated. Depending on whether the water strikes incline surfaces 384A or 384B, the swirl plate will be rotated slightly either clockwise or counter-clockwise with respect to the swirl plate housing 376, twisting coil spring 424 in the clutch assembly 319. The amount of rotation of the swirl plate, as described above, is limited by the length of travel of the elongated slots 386 in the underside of the swirl plate with respect to the stationary indexing numbers 400 extending upwardly therethrough from the swirl plate housing 376.

The water passing through the swirl plate is caused to swirl by deflection ribs 384 about ball track 406, driving drive ball 404 about the track and repeatedly against either inclined protruding slightly curved cam surface 408 or 409 on cup 402 of the bearing spindle 308, depending on the direction of the swirl, and thus effecting a slow corresponding clockwise or counterclockwise rotation of the bearing spindle 308, nozzle element 302, bearing guard 310 and cap assembly 304. The sprinkler upper and lower housings 318 and 316, the swirl plate 317, the swirl plate housing 376, flow selector 378, direction control shaft 374, and trip member 356 remain stationary. This rotation continues until either depending dog 338 on the rotating direction control cap 322 or the stop 342 on the rotating trip collar 324 impact the trip stop 370 projecting radially from the trip member 356. At such time, the force of the impact, transmitted to the swirl plate by the direction control shaft 374, and the potential energy, stored in the coil spring 324 will overcome the force of the incoming water on deflection ribs 384 and rapidly rotate the swirl plate 317 in the opposite direction of its previous rotation until the indexing members 400 on the swirl plate housing 376 abut the opposite ends of the elongated slots 386 in the underside of the swirl plate. Such counter rotation of the swirl plate moves each of the deflection ribs 384 across one aperture 398 in the swirl plate housing 376, bringing the other of surfaces 384B and 384A on the deflection ribs into the path of the incoming water. This effects a reversal of the direction of the swirling water exiting the swirl plate and driving the ball 404 about ball track 406 in the opposite direction thereby reversing the direction of rotation of the bearing spindle and the nozzle head. For example, if the incoming water initially impacted surfaces 484A on the deflection ribs causing a clockwise rotation of the swirl plate 317 and of the water passing therethrough, the impact of stop 342 against trip stop 370 will cause a counter rotation of the swirl plate such that deflection surfaces 384B are brought into the path of the incoming water, thereby reversing the direction of swirl and thus the direction of rotation of the bearing spindle, nozzle element, cap assembly and bearing guard. With each repeated impact of the drive ball 404 against protruding cam surface 409, such counter-clockwise rotation continues until the slowly rotating depending dog 338 on the direction control cap strikes the stationary trip stop 370 on the trip member 356. This impact causes spring 424 in the clutch assembly to again reverse the orientation of the swirl plate in the inner cap housing, bringing surfaces 384A on the deflection ribs back into the path of the incoming water, thereby providing a continuously reversing rotational spray path with the degrees of arc of the spray path being determined by the degrees of arc separating the stop 342 on the trip collar and the depending dog 338 on the direction control cap.

By way of an illustrative example, when stop 342 and dog 338 are in vertical alignment as seen in FIG. 15A, the sprinkler 300 will provide a 360° reversing spray. To obtain a 270° arc of throw, direction control cap 322 is rotated 90° with respect to trip collar 324, to move the depending dog 338 on the direction control cap 322 from the solid line position in FIG. 15A to the phantom line position shown therein and illustrated in FIG. 15B. As water flows through the sprinkler, the direction control cap 322 and trip collar rotate clockwise until depending dog abuts trip stop 370 on the trip member 356 as seen in FIG. 15C. The direction of rotation is then reversed by rotation of the swirl plate 317 as described above and as illustrated in FIG. 15D. This counter clockwise rotation will continue until stop 32 on the trip collar 324 abuts stop 370 as seen in FIG. 15E whereupon the direction of rotation is again reversed thereby providing continuous 270° water coverage.

Through the aforesaid configuration, any desired arc of throw from 60°–360° is readily achieved through simple manual rotation of the direction control cap 322 with respect to the trip collar 324 to appropriately space apart the depending dog 338 and stop 342 carried thereby.

THE FOURTH EMBODIMENT

The fourth embodiment of the present invention, illustrated in FIGS. 20–42, is a highly efficient pop-up sprinkler device 500 adapted for use on large turf areas such as golf courses, parks and playing fields and operable with water pressures as lows as 20 psi. Sprinkler 500 is similar in many respects to the sprinkler device 300 of the third embodiment and comprises many of the same or substantially similar elements. The major differences between the two devices include the addition of the pop-up feature in the fourth embodiment, the mounting of the clutch assembly above the sprinkler nozzle, the configuration of the nozzle head, the use of permanently sealed bearings, and the inclusion of means for regulating the rotational speed of the sprinkler nozzle head to maintain a relatively constant rate of rotation regardless of the volume of flow through the sprinkler and thereby providing a more versatile sprinkler device which is capable of providing an even more uniform water coverage over any preset arc of throw.

Sprinkler device 500 includes a bearing spindle 502 rotatably mounted in a pop-up sleeve 504, an index collar 506 affixed to the bearing spindle adjacent the upper end of sleeve 504, a nozzle head 508 slidably mounted on the bearing spindle between indexing collar 506 and the clutch housing 510 which is affixed to the upper end of the bearing spindle 502. The clutch assembly 512 and direction control mechanism 514 are disposed within the clutch housing 510. The flow selector 516, swirl plate housing 518 and swirl plate 520 are mounted within sleeve 504 below the ball drive assembly 519 as in the third embodiment. As will be more fully described, each of these elements are mounted in an outer casing 522 adapted to be buried underground and are spring-loaded such that upon directing water to sprinkler 500, pop-up sleeve 504 and the aforesaid components carried thereby are caused to pop upwardly from and project out of casing 522 for the spraying of water therefrom as illustrated by FIG. 21.

Disposed within the lower portion of pop-up sleeve 504 is a filter element 524 of similar configuration to the sprinkler elements described above in the prior embodiments. Filter element 524 is affixed at its upper end to the flow selector 516 such that rotation of the filter element 524 rotates the flow selector with respect to the swirl plate housing 518 disposed immediately thereabove. A tubular extension 722 is provided on the lower end of the filter element which projects downwardly beyond the lower end 724 of pop-up sleeve 504 to facilitate manual rotation of the filter element 524 and flow selector 516.

The swirl plate 520 is disposed within the swirl plate housing 518 and held therein by swirl plate rivet 526 as described above with respect to the third embodiment of the present invention. As illustrated in FIGS. 20 and 24, a push nut 528 extends between and bears against the underside of the flow selector 516 and the spindle portion 529 of the swirl plate housing 518 to hold the flow selector against the underside of the swirl plate housing as in the third embodiment. The configuration of the flow selector 516 and swirl plate housing 518, however, differ from the flow selector and swirl plate housing of the third embodiment to provide means for regulating the rotational speed of the bearing spindle 502 and thus the nozzle head 508 as well.

The flow selector 516, illustrated in detail in FIGS. *22a–22c*, is rotatably mounted within pop-up sleeve 504 and is comprised of a horizontal disc-shaped upper wall portion 530 and a depending annular collar portion 532 which is adjacent and extends parallel to pop-up sleeve 504. The horizontal wall portion defines a central aperture 534 therein through which the depending stem portion 536 of the swirl plate housing 518 extends. As seen in FIGS. *22a–24*, four sets of differently sized water entry nozzles 538, 540, 542 and 544 are arcuately disposed about the flow selector in wall portion 530 thereof, and are radially spaced outwardly from central aperture 534. Each set is comprised of three adjacent nozzles, e.g., set 538 comprises nozzles 538', 538'' and 538'''. Space permitting, a different number of sets or nozzles within the sets could be employed if desired. To improve the hydraulic efficiency of the flow selector 516, each nozzle is defined by a downwardly extending frustoconically shaped wall portion **538*a*, 540*a*, 542*a* and 544*a*** defining outward tapers of about 30° as illustrated in FIG. *22b*. Entry nozzles 538', 540', 542' and 544' each preferably define an inner diameter opening within the range of 0.114–0.117 in. Nozzles 538'', 540'', 542" and 544" define an inner diameter opening of about 0.098–0.101 in. and nozzles 538'''–544''', an opening of about 0.61–0.064 in. By varying the size of the water entry nozzles, different volumes of water flow can be directed to swirl plate 520, depending on which of the three sizes of inlet nozzles are collectively aligned with the four arcuately spaced apertures 546 in the swirl plate housing 518. By being able to vary the water flow to the swirl plate, one can adjust the water flow through sprinkler 500 to a desired level. As will be described, differently sized outlet orifices are provided in nozzle head 508 to accommodate the desired volume of flow through the sprinkler and minimize the pressure drop across the sprinkler. In addition, varying the velocity of the water flow to the swirl plate by the alignment of flow selector 516, without correspondingly varying the size of the outlet orifice will vary the speed of rotation of the nozzle head 508. The larger the aligned inlet nozzles in the flow selector, the lower the velocity of water passing to the swirl plate, and hence the slower the speed of rotation. However, constant and relatively slow as opposed to high speed rotation is generally desired. By balancing the size of the inlet nozzles in the flow selector with the size of the outlet orifice in the nozzle head and the amount of water bypassing the swirl plate, a slow speed of rotation with varying volumes of water passing through the sprinkler can be obtained with minimal pressures loss. However, by simply varying the size of the water entry nozzles, one can effect a faster speed of rotation, which may be desired under certain circumstances such as during the seed germination period when a slower sprinkler rotation can result in a crusting of the soil.

The swirl plate housing 518 is illustrated in detail in FIGS. 23*a*–23*c* and is rigidly secured in pop-up sleeve 504 adjacent and above the flow selector 516 as seen in FIG. 20. To facilitate securement of the swirl plate housing 518 in pop-up sleeve 504 without distorting the inside dimensions thereof, a plurality of radial projections 517 terminating in sharp points are provided on the outer wall of the swirl plate housing 518 which cut into the interior of pop-up sleeve 504 and retain the swirl plate housing in place.

To properly align the inlet nozzles on the flow selector 516 with apertures 546 on the swirl plate housing 518, four equally spaced, upwardly projecting indexing protuberances 553 are formed in the upper horizontal wall portion 530 of the flow selector. Four sets of three detents 554 each are disposed about the underside of the swirl plate housing 518 for receiving the indexing protuberances 553 to selectively position and retain one uniform size of water entry nozzle from each set thereof on the flow selector in vertical alignment with each of the four apertures 546 in the swirl plate housing. As one of each of the three detents 554 in each set thereof positionally corresponds with one of the three differently sized inlet nozzles in each set thereof in the flow selector, such uniform alignment is easily obtained upon rotation of the flow selector with respect to the swirl plate housing.

The flow selector 516 also defines water bypass apertures 548 disposed radially adjacent entry nozzles 538", 540", 542" and 544" and a pair of water bypass apertures 550 radially adjacent entry nozzles 538''', 540''', 542''' and 544''' as seen in FIG. 22*a*. Each of the bypass apertures has a diameter of about 0.071–0.074 in. In addition, the upper end of the annular collar portion 532 of the flow selector 516 defines four equally spaced upwardly projecting arcuate flanges 556 which extend into four arcuate recesses 558 formed in the outer cylindrical wall 560 of the swirl plate housing 518 to limit the relative rotation of the flow selector 516 with respect to the swirl plate housing 518 to the arcuate distance which flanges 556 can travel within recesses 558. The swirl plate housing 516 additionally defines four elongated bypass slots 552 in the horizontal disc shape wall portion 564 thereof adjacent cylindrical wall 560 and between arcuate recesses 558.

Through the aforesaid configurations of the flow selector 516 and swirl plate housing 518, there are three different settings of the flow selector with respect to the swirl plate housing which are dictated by indexing protuberances 553 and detents 554. In a first setting, the smallest of the water entry nozzles in each of the four sets thereof, i.e., 538', 540', 542', and 544', are aligned with the apertures 546 in the swirl plate housing 518. In this setting, none of the bypass apertures in the flow selector are aligned with the bypass slots 552 in the swirl plate housing and all of the incoming water is thus directed to the swirl plate 520. In this setting, a minimum volume of water is passed to the sprinkler nozzle head 508. In a second setting, the middle sized water entry nozzles 538", 540", 542" and 544" are each aligned with the apertures 546 in the swirl plate housing 518 and the bypass apertures 548 in the flow selector 516 are aligned with the bypass slots 552 in the swirl plate housing 518. In the third setting, the largest of diameter water inlet nozzles, i.e., 538'''–544''', are aligned with the apertures 546 in the swirl plate and the two adjacent bypass apertures 550 are aligned with the bypass slots 552 in the swirl plate housing to increase the volume flow of water bypassing the swirl plate and thereby preventing overspeeding of the nozzle head 508. It should be noted that in the preferred configuration of this embodiment, two bypass apertures 550 are disposed radially adjacent each of the largest water entry nozzles 538'''–544''' in lieu of an oversized bypass aperture solely for manufacturing reasons. It is important to balance the flow selector. Proper balance is more easily achieved through the formation of two circular apertures as opposed to one elongated aperture in that the exterior radial space for such apertures adjacent the nozzle elements is limited and diameter control is more easily obtained in the formation of a circular aperture as opposed to an elongated slot.

Swirl plate 520, illustrated in detail in FIGS. 25*a*–25*d*, is similar in configuration to swirl plate 317 in the third embodiment, except that a centrally disposed tubular extension 566 (FIG. 20) is sonically welded or otherwise suitably affixed to the upper surface of swirl plate 520 for sealing the upper end of the swirl plate rivet 526 from the central chamber 568 of the sprinkler and for directly attaching the direction control shaft 570 to the swirl plate 520. For this purpose, the tubular extension 566 preferably defines a square central channel therein to receive the correspondingly shaped shaft 570. As seen in FIG. 25*a*, swirl plate 520 additionally defines four equally spaced dogs 572 projecting radially from the outer cylindrical surface thereof which extend into the arcuate areas 574 formed in the interior of cylindrical wall 560 of the swirl plate housing by the inwardly projecting recesses 558. The amount of rotation of the swirl plate 520 with respect to the swirl plate housing 518 is limited by these projecting dogs 572 abutting the inwardly projecting end walls 576 of recesses 558 which boarder arcuate areas 574. As illustrated in FIG. 26, radial dogs 572 on the swirl plate 520 and projecting end walls 576 on the swirl plate housing 518 thus achieve the same purpose and function in a similar manner as the indexing members 400 and slots 386 on the swirl plate housing 376 and in swirl plate 317 of the third embodiment described earlier herein.

Bearing spindle 502 of sprinkler device 500 differs from bearing spindle 308 in the third embodiment only in the size and upper end thereof and in the inclusion of longitudinal vanes 582 extending substantially the length of the tubular extension portion 503 thereof to inhibit the swirling motion of water passing upwardly therethrough. The lower portion of the bearing spindle 502 is of the same configuration as bearing spindle 308 and is rotated either clockwise or counter-clockwise by drive ball 586 as a result of the water being caused to correspondingly swirl about ball track 588 by swirl plate 520.

Sealing means 590 for sprinkler 500 is disposed between a flat, horizontal annular surface 592 on the cup portion 594 of the bearing spindle 502 and the lower ends of a pair of interior depending cylindrical concentric walls 596 and 598 defined in the upper end of the pop-up sleeve 504. Sealing means 590 comprises a stainless steel wave spring 600 disposed against and immediately below the ends of concentric walls 596 and 598, followed by a stainless steel washer 602, a resilient cup seal 604 preferably constructed of buna-n rubber and having an enlarged outer diameter to provide increased sealing protection at low pressure operation, a second stainless steel washer 606, a teflon washer 608 of reduced outer diameter, and a resilient washer 610 preferably constructed of buna-n rubber. Bearing seal 604 is also preferably constructed of buna-n rubber and defines an upwardly and inwardly tapered wall portion 612 terminating in an inwardly directed radial flange 614 bearing against cylindrical wall 596 in pop-u sleeve 504 to seal the wave spring 600 and washer 602 from the central chamber 613 in the upper end of pop-up sleeve 504 and thus prevent foreign matter from passing through seal means 590 and between the rotating bearing spindle 502 in stationary pop-up sleeve 504.

Indexing collar 506 is rigidly affixed to the bearing spindle 502 adjacent the upper end of the inner cylindrical wall 596 of pop-up sleeve 504 within which the bearing spindle 502 is journalled. Collar 506 comprises a horizontal annular nozzle head support surface 620 and a depending annular flange portion 622 extending downwardly over the upper end 624 of the pop-up sleeve 504. For efficient utilization of space within outer casing 522, the flange portion 622 of indexing collar 506 defines an annular recessed area 625 about the upper end thereof which receives the lower end of nozzle head 502, while the lower end of flange portion 622 is itself received in an annular recessed area 627 in the upper end of pop-up sleeve 508. The horizontal support surface 620 of indexing collar 506 defines a plurality of arcuately spaced recessed areas 621 therein adapted to receive correspondingly configured and spaced protrusions 623 on the underside of the nozzle head 508 for proper alignment of the nozzle head with respect to the bearing spindle 502.

Nozzle head 508, illustrated in detail in FIGS. 32*a* and 32*b*, defines an inner cylindrical wall portion 626, an outer cylindrical wall portion 628, and a plurality of upwardly inclined, open-ended nozzle conduits 630 equally spaced about nozzle head 508 and extending between inner and outer cylindrical wall portions 626 and 628 thereof. Three such nozzle conduits are provided in the nozzle head configuration illustrated in the drawings. Nozzle head 508 is slidably mounted on the tubular extension portion 503 of bearing spindle 502 about a reduced diameter portion 505 thereof above indexing collar 506. The lower end of inner wall portion 626 of head 508 is disposed over a portion of the upper end of indexing collar 506 and abuts a shoulder 629 on the bearing spindle 502 at the lower end of the reduced diameter portion 505 thereof. The protrusions 623 on the underside of nozzle head 508 are positioned such that upon their being received within recesses 621 in indexing collar 506, one of the three nozzle conduits 630 will be aligned with an aperture 638 in the tubular extension 503 of the bearing spindle for the passage of water therethrough. An arcuate head spring 639 is disposed about extension 503 and bears against the underside of clutch housing 510 and the inner wall 626 of nozzle head 508 to urge the nozzle head downwardly against indexing collar 506 and the shoulder 629 on the bearing spindle 502.

Three differently configured nozzle elements 632A, 632B and 632C are provided in the nozzle head 508 to accommodate different volumes of flow therethrough as determined by the alignment of the flow selector 516. One nozzle element is secured in each of the conduits 630 against an annular shoulder 634, although only element 632A is shown in FIGS. 20 and 32A. By coordinating the size of the outlet orifice in the nozzle element with the volume of flow through the sprinkler, the desired flow volume can be provided with a minimal pressure loss. Each of nozzle elements 632A–C defines an inwardly tapered frustoconical surface 633 terminating in a circular outlet orifice 635. Each of the outlet orifices 635 has a radial slot 637 projecting from the lower surface thereof at an orientation of 6:00 o'clock with respect to the orifice 635. A plurality of radial straightening vanes 641 are disposed within each nozzle element to reduce the turbulence of the water passing therethrough. In the preferred configuration, six such vanes disposed 60° apart project radially from a ring 643 which is held with each nozzle element.

FIGS. 32*a*, 32*b* and 35 illustrate the configuration and various dimensions of nozzle elements 632A, 632B and 632C. The letter designations A through D heading the columns in FIG. 35 correspond to the dimensions represented by the same letters in FIGS. 33*a* and 33*b*. A fourth nozzle element 632D is added to the table in FIG. 33*b* as being representative of a standard fourth size nozzle having an orifice diameter of 7/32 in. which could also be employed with the present invention either in addition to or in lieu of one of the other sizes. The column heading "NOZZLE COLOR" refers to the color of the nozzle elements 632A–D, the purpose for which will be discussed later herein.

In the present embodiment, nozzle element 632A, which defines the smallest fluid outlet orifice, would be generally utilized with the smallest water entry nozzle 538, in the flow selector 516 to obtain a flow rate of about two gallons per minute through the sprinkler 500. Nozzle element 632B would typically be employed with water inlet nozzle 538'' to provide a fluid flow of about three and one-half gallons per minute through the sprinkler and nozzle element 632C would be employed with the largest water inlet nozzle 538''' to provide a fluid flow therethrough of about six gallons per minute. The means for facilitating coordination of the particularly sized nozzle elements in the sprinkler head with the corresponding inlet nozzles on the flow selector to obtain a desired volume of flow through the sprinkler will be described later herein.

As seen in FIGS. 20 and 32*a*, a nozzle diffuser/deflector 640 is rotatably disposed about nozzle head 508 to diffuse and deflect the water exiting the nozzle element as described with respect to the prior embodiments. Nozzle diffuser/deflector 640 is generally of the same configuration and functions in the same manner as nozzle deflectors 306 and 206 of the second and third embodiments of the present invention.

Clutch housing 510, seen in FIGS. 20, 31*a* and 32*b*, is sonically welded or otherwise rigidly affixed to the upper end of the bearing spindle 502 for rotation therewith. Clutch housing 510 defines an outer cylindrical wall portion 642, an inner cylindrical wall portion 644, a bottom wall portion 646 and a depending centrally disposed tubular extension 648 for receiving the upper end of bearing spindle 502. Tubular extension 648 defines a radial projection 650 which extends into bearing spindle 502 for rigid securement of the clutch housing to the bearing spindle. The juncture of the outer cylindrical wall portion 642 of the clutch housing with the horizontal clutch support wall portion 646 defines an arcuate recess 652 to accommodate the upper end of the nozzle deflector 640.

The clutch assembly 512 is disposed in the lower portion of the clutch housing 640 and, as best seen in FIGS. 36–39, includes a clutch member 656, an inner trip housing 658 and a clutch cap 660. Clutch member 656 is comprised of a depending cylindrical shaft portion 662 and an upper disc portion 664. The upper disc portion 664 is disposed within inner trip housing 658 and the shaft portion 662 extends downwardly therefrom and into the tubular extension 503 of bearing spindle 502, through a centrally disposed aperture 659 in the inner trip housing 658. Clutch member 656 also defines a small cylindrical collar portion 663 at the juncture of the shaft and disc portions thereof which rest directly on the bottom wall 668 of the inner trip housing about aperture 659 therein. The inner trip housing in turn defines a cylindrical projection 665 which rests on the bottom wall portion 646 of the clutch housing 640 about the upper end of the depending tubular extension 648 thereon. The cylindrical shaft portion 662 of the clutch member 656 defines a square elongated channel 666 therein for receiving in a sliding key fit the upper portion of the direction control shaft 570 thereby mechanically coupling the clutch assembly 512 to the swirl plate 520 through shaft 570 such that any rotation of the swirl plate is imparted to the clutch member 656 and vice versa.

As seen in FIG. 37, the disc portion 664 of clutch member 656 has an upstanding annular flange 668 extending about the perimeter thereof. Flange 668 has a vertical slot 670 cut therein to receive the radially projecting outer end of a concentric coil spring 672. The inner end of spring 672 is disposed within a slot 674 in a centrally disposed depending annular wall 676 defined by the clutch cap 660, while the coiled body portion of spring 672 is disposed about a raised cylindrical hub 678 centrally disposed on the disc portion of the clutch member 656. An annular radial projection 680 is defined in the upper end of the tubular extension of bearing spindle 502 to act as a centering guide for the shaft portion 662 of clutch member 656.

Clutch cap 660 includes an annular horizontal disc portion 682 from which annular wall 676 depends, and a cylindrical extension 684 projecting upwardly from disc portion 682 in axial alignment with the shaft portion 662 of the clutch member 656. The disc portion 682 of clutch cap 660 is secured about its perimeter to the upper end of the cylindrical wall 685 of the inner trip housing 658 to secure cap 660 to the inner trip housing 658 and seal the spring mechanism of the clutch assembly from the intrusion of foreign matter. The outer surface of cylindrical wall 685 of the inner trip housing 658 defines an outwardly projecting radial stop 686 thereon adapted to abut an inwardly radially projecting stop 688 on the clutch housing 640 upon rotation of the clutch housing with respect to the trip housing. The interior surface of the cylindrical wall 685 of the inner trip housing defines a pair of oppositely directed arcuate inclined camming surfaces 690 for disengaging the radially extending outer end of concentric coil spring 672 from the slot 670 in the perimeter flange 668 of the clutch member 656 upon manual rotation of the clutch housing and nozzle head with respect to the stationary clutch member in the same manner in which the camming surfaces 414 in the prior embodiment disengage end 422 of spring 422 from the notch 421 in clutch assembly 319, to prevent overstressing the clutch spring.

A direction control member 692 illustrated in FIGS. 20 and 40*a–c* is disposed within the upper end of the clutch housing 640 interiorly of cylindrical wall portion 644 thereof. Direction control member 692 is of single piece construction and defines a radial upper end flange 694, a cylindrical wall portion 696, a first annular recess 698, a second annular recess 700, a lower horizontal annular wall portion 702 and a cylindrical extension 704 adapted to receive extension 684 of the clutch cap 660. The inner wall portion 644 of clutch housing 640 is provided with an annular recess 705 interiorly adjacent recess 698 in the direction control member 692 and a split locking ring 707 extends between recesses 705 and 698 to retain the direction control member within the clutch housing but allow for manual rotation of the direction control member within the clutch housing. An "o" ring 706 is disposed in a second annular recess 700 in the direction control member and bears against the direction control member 692 and the cylindrical wall portion 644 of the clutch housing to provide a seal therebetween. The direction control member 692 also defines a radial stop 710 which projects outwardly from the cylindrical wall portion 696 thereof and a depending dog 714 axially aligned with radial stop 710. Dog 714 is adapted to abut the outwardly projecting stop 686 on the inner trip housing 658 upon rotation and counter-rotation of the nozzle head 508 and clutch housing 640 with respect to the inner trip housing 658.

A direction control ring 708, illustrated in FIGS. 20 and 41*a–c*, is disposed about the direction control member 692 between the upper end of the cylindrical wall 644 of the clutch housing and the cylindrical wall portion 696 of the direction control member 692 and is sonically welded or otherwise permanently affixed to the upper end of wall 644 of the clutch housing 640. A removable cap 716 is disposed over the upper end of direction control member 692 and is secured to the upper end of the clutch housing 640 by a snap fit.

The above described clutch assembly 512 and direction control mechanism 514 operate in a similar manner to the corresponding components in the prior embodiment. As previously described, the water passing through the swirl plate 520 rotates the swirl plate either clockwise or counter-clockwise, depending on the orientation of the deflection ribs therein with respect to apertures 546 in the swirl plate housing 518. The amount of such rotation is limited by the travel of the radially projecting dogs 572 thereon within arcuate areas 574 in the swirl plate housing. Such rotation is transmitted by the direction control shaft 570 to the clutch member 656 in the clutch assembly, stressing the clutch spring 672. The water passing through the swirl plate then drives the bearing spindle 502 within pop-up sleeve 504, as described with respect to the previous embodiment by means of ball drive assembly 519. The bearing spindle in turn rotates the indexing collar 506, nozzle head 508 and the clutch housing 640. Rotation continues until stop 688 on the clutch housing strikes the stop 686 on the exterior side wall of the inner trip housing 658 or the depending dog 714 on the direction control member 692. Whether stop 686 or dog 714 is abutted by moving stop 688 on the clutch housing depends on whether the clutch housing is being rotated in a clockwise or counter-clockwise direction. As soon as either stop 686 or dog 714 is impacted by stop 688, the force of the impact plus the stored energy in the clutch spring 672 will overcome the force exerted on the swirl plate 520 by the incoming water and counter-rotate the swirl plate within the swirl plate housing in the opposite direction of its prior rotation, thus affecting a reversal of rotation of the bearing spindle, nozzle head and clutch housing as previously described with respect to the prior embodiment.

By manually rotating the direction control member 692 with respect to clutch housing 640, the angular separation of dog 714 on the direction control member with respect to stop 688 on the clutch housing is varied and the arc of throw for the sprinkler is set. Stop 688 and dog 714 will be continuously rotated back and forth by the ball drive against stop 686. To prevent stop 688 on the clutch housing 640 from damaging dog 714 on direction control member 692 by too forceful a rotation of the direction control member, while setting the arc of throw, the direction control ring 708 which is affixed to the clutch housing 640, is provided with an inwardly projecting radial stop 712 which is in fixed axial alignment with stop 688. Accordingly, when the depending dog 714 abuts stop 688, the radial stop 710 on the direction control member 692 concurrently abuts stop 712 on the direction control ring 708, thereby decreasing the force of the impact on dog 714.

Through the aforesaid configuration, the user can obtain uniform coverage over the area to be watered, regardless of the preset arc of throw. This is accomplished by coordinating the differently sized inlet nozzles 538'–544''' on the flow selector 516 with the differently sized nozzle elements 632A–632C in the nozzle head 508 for the particular preset arc of throw. If a greater volume of water is desired for a preset area, the flow selector can be independently adjusted to align a larger sized inlet aperture thereon with the apertures 546 in the swirl plate housing.

To assist the user in setting the desired arc of throw and coordinating the differently sized inlet nozzles and nozzle element, various indicia are provided about the sprinkler 500. In the preferred configuration of sprinkler 500, color coding is employed. The upper surface 718 of the direction control ring 708 is divided into three arcuate areas identified by different colors, e.g., green, yellow and red. In addition, written indicia are disposed thereon to indicate the different arcs of throw. For example, four dots could be equally placed about the ring to indicate arcs of throw of 360°, 270°, 180° and 90°. A radially directed arrow indicator 709 is disposed atop upper end flange 694 of the direction control member 692. To preset the sprinkler to the desired arc of throw, cap 716 is first removed from the upper end of the clutch housing 640, and the direction control member 692 is manually rotated with respect to the clutch housing to align the indicating arrow 709 on the top thereof with the indicia on the upper surface of the direction control ring 708 indicating the desired arc of throw. To assist the user in gripping the direction control member 692, the annular end flange 694 thereof is preferably provided with a plurality of spaced semi-circular cut-out areas 720 to provide flange 694 with a knurled-like outer surface. It should be noted that the radial stop 710 projecting from the direction control member 692 below the upper end flange 694 thereon and the radial stop 712 on direction control ring 708 are provided to prevent the depending dog 714 on the direction control member from being inadvertently sheared off by stop 688 on the clutch housing as a result of too forcefully rotating the direction control member within the clutch housing to preset the arc of throw. At such point as the depending dog 714 would strike stop 688 during such adjustment, stop 710 on the direction control member 692 abuts the radial stop 712 on ring 708 to decrease the force of the impact on dog 714 against stop 688.

When the desired arc of throw has been preset, the indicating arrow 709 on the direction control stop 692 will not only be pointing at the indicia indicating the preset arc of throw, but will additionally be pointing at one of the three colored areas on the upper surface of the retention ring 708. As indicated by FIG. 35, each of the nozzle elements 632A–C is colored a different color corresponding to the colors on the upper surface of the direction control ring 708. Nozzle 632A is colored green, nozzle 632B is yellow and 632C is red. These differently colored nozzles are clearly visible from the exterior of the sprinkler through the conduits 630 in the nozzle head in which the elements are secured. The user then merely aligns the nozzle element of the particular color towards which the arrow indicator 709 on the direction control stop is pointing with the interior aperture 638 in the bearing spindle 502. This is easily accomplished by gripping the nozzle head 508 and indexing collar 506, raising the nozzle element with respect to the indexing collar which compresses head spring 639 and raises the protrusions 623 on the underside of the nozzle head out of the alignment detents 621 in the upper surface of the indexing collar. The nozzle head is then simply rotated about the bearing spindle to bring the desired colored nozzle element into alignment with an arrow or other indicating mark disposed on the indexing collar 506 which is in vertical alignment with the water outlet aperture 638 in the bearing spindle. Upon releasing the nozzle head, head spring 639 will urge the nozzle head back against the indexing collar whereupon the protrusions 623 will seat within detents 621, securing the nozzle head in place and the selected color nozzle element in alignment and fluid communication with the aperture 638 in the bearing spindle.

To assist the user in aligning the desired sized inlet nozzle in the flow selector 516 with the apertures 546 in the swirl plate housing, the lower end of filter element 524 is provided with a tubular extension 722 which protrudes from the lower open end 724 of pop-up sleeve 504 to facilitate rotation of the filter element 524 and rotation of the flow selector 516. The extended end 726 of filter extension 722 has a raised radially pointing arrow 727 formed therein. As seen in FIG. 42, the outer filter casing 522 within which the pop-up spindle 502 and elements carried thereby are mounted, has a label 728 affixed thereto about threaded collar 730 adjacent the indicating arrow 727 on the extended end of the filter element. Label 728 contains a green marking 732, a yellow marking 734 and a red marking 736 with each of said markings being spaced about 20° apart, corresponding to the arcuate spacing between the water entry nozzles 538'-538''' on the flow selector 516. By rotating the filter element 524 to point the indicating arrow 727 thereon at the one of the differently colored markings 732-736 on label 728 which corresponds to the color of the nozzle element 632A, B or C being used, the particularly sized water entry nozzles 538'-544''' adapted for use with that nozzle element are brought into alignment with the apertures 546 in the swirl plate housing 518. By thus coordinating the preset arc of throw with the particularly sized nozzle element in the sprinkler head and inlet nozzles in the flow selector, the sprinkler 500 will provide a relatively constant volume of water coverage regardless of the preset arc of throw, allowing a number of sprinklers 500 to be used in a given sprinkler line with varying preset arcs of throw, with each sprinkler providing the same volume of coverage, regardless of the arcuate range over which the sprinkler is spraying. If the user wished to increase or decrease the volume of flow for a particular area, he or she could do so by mismatching the inlet nozzles in the flow selector with the selected arc and nozzle size. By aligning larger water entry nozzles in the flow selector with the apertures in the swirl plate housing, the sprinkler nozzle would rotate faster and the volume of flow through the nozzle element would be increased.

Sprinkler 500 is particularly designed for use as a pop-up sprinkler. Accordingly, the pop-up sleeve 504 is springloaded in the outer casing 522 such that upon activating the water flow to the sprinkler, the pop-up sleeve and the elements carried thereby are caused to pop up out and extend over casing 522 prior to discharging water therethrough and, upon cessation of the fluid flow therethrough, to be retracted into the casing below ground. To provide this pop-up feature, the outer casing 522 is provided with a threaded collar 730 at the lower end thereof for threaded securement to the sprinkler line below ground level. The upper end of the outer casing threadably engages a protective end cap 740. End cap 740 defines an inclined annular surface 742 against which a mating surface 744 on the clutch housing cap 716 rests. An "X"-shaped annular wiping seal 745, preferably constructed of buna-n rubber and teflon coated, is held between the outer wall 642 of the clutch housing 640 and the inner surface of casing 522 by a depending annular wall 746 on end cap 740 and an upwardly projecting annular wall 748 on a spring guide 750 secured in the upper end of casing 522. A coil spring 752 bears against a radial flange 754 formed at the lower end of the pop-up sleeve 504 and is secured at its upper end to the spring guide 750. Upon activation of the sprinkler line, water passes through the collar 730 in casing 522 and into the interior of the pop-up sleeve 504 about and through filter element 524 therein. The force of the incoming water moves the pop-up sleeve 504 and all the elements carried thereby upwardly within the outer casing 522, compressing coil spring 752. As soon as the water pressure is turned off, the stored energy in the extended coil spring retracts the sprinkler back into its outer casing below ground. To prevent pop-up sleeve 504 from rotating within outer casing 522, ears 760 are provided in the lower portion of casing 522 which engage flange 754 on sleeve 504.

The annular wiping seal 745 is particularly configured so as to not only provide an effective watertight seal for sprinkler 500 when in use and after shut down, but to provide an anti-siphon check valve as well. Due to the "X"-shaped configuration of seal 745, each side thereof defines an upwardly and outwardly projecting leg portion 745, and a downwardly and outwardly projecting leg portion 745''. When the sprinkler is in the raised operative position, the leg portions on the exterior side of seal 745 bear against the interior surface of outer casing 522, while the interiorly directed leg portions bear against the exterior surface of pop-up sleeve 504. In this position, the lower leg portions 745'' of the seal project downwardly into the flow path of the incoming water and are pressed outwardly thereby against the casing and clutch housing, providing a pair of wear resistant and watertight lip seals therebetween.

When the sprinkler is in the lower inoperative position within casing 522, leg portions 745'' bear against the casing and the outer surface of the clutch housing. In the event sprinkler 500 is disposed downhill of at least a portion of the sprinkler line such that a pressure head exists upon shutting off the water flow to the sprinkler line, leg portions 745'' again act as lipseals and prevent any leakage through the sprinkler. Should a vacuum be created upstream of sprinkler 500, as for example by a breakage in the pipeline, the upper leg portions 745' of seal 745, which also bear against the casing and clutch housing, would similarly prevent any leakage which could otherwise contaminate the water supply and/or interfere with the free rotation of the moving pads in the sprinkler.

Sprinkler 500 is adapted to provide a larger fluid flow therethrough than the prior embodiments and accordingly is of a larger configuration. By way of example, ball track 588 is preferably about 1.19 in. in diameter and the protruding cam surfaces thereon each defines a radius of about 0.203 in. Drive ball 586 is 0.406 in. in diameter. Pop-up sleeve 504 has an outer diameter about the major position of its length of 1.390 in. and an overall length of 5.050 in. The outer case 522 is 2.187 in. in diameter. The sprinkler is adapted to pop up out of casing 522 upon the pressure reaching about 12-15 psi and to operate at a line pressure of 20-80 psi. With the nozzle elements in the nozzle head coordinated with the appropriate inlet nozzles in the flow selector and arc of throw as described earlier herein, the flow rates for sprinkler 500 are about 2 gal/min with the smallest nozzles, about 4 gal/min with the intermediate sized nozzles and about 7 gal/min with the largest nozzles. These flow rates can, of course, be altered by mismatching the water outlet and inlet nozzles as noted above.

I claim:

1. A rotary sprinkler device adapted to be communicated with a water line for the distribution of water therefrom, said device comprising a fluid inlet, a nozzle head, a body member disposed within said fluid inlet and said nozzle head, an interior chamber disposed within said body member, a bearing spindle extending into said chamber and communicating said fluid inlet with said nozzle head for directing fluid flow therethrough from said fluid inlet to said nozzle head, said spindle being at least partially disposed within said body member and mounted for relative rotation and axial movement between said bearing spindle and said body member, drive means responsive to fluid flow from said inlet through said bearing spindle for rotating said nozzle head, an internal annular sealing means disposed within said chamber about a first portion of said bearing spindle and extending axially between a second portion of said bearing spindle and a portion of said body member for preventing water flow through said bearing spindle from passing between adjacent surfaces of said bearing spindle and said body member, and biasing means having a predetermined load rate disposed within said chamber about said first portion of said bearing spindle and bearing against said sealing means for preloading said sealing means in compression between said second portion of said bearing spindle and said portion of said body member to maintain a continuous seal therebetween, said biasing means compressing upon the water pressure within said body member exceeding said load rate, whereupon the bearing friction between said body member and said bearing spindle is not affected by said biasing means.

2. The sprinkler device of claim 1 wherein said sealing means comprises a plurality of axially aligned abutting resilient and rigid washers, said biasing means abutting one of said rigid washers.

3. A sprinkler device as in claim 1 wherein said biasing means comprises an annular wave spring, said wave spring being held in compression by and between said second portion of said bearing spindle and said sealing means and defining a spring load sufficient to allow said spring to undergo further compression upon the water pressure within said body member reaching 15 p.s.i.

4. A rotary sprinkler device adapted to be communicated with a water line for the distribution of water therefrom, said device comprising a fluid inlet, a fluid outlet, a body member disposed between said fluid inlet and said fluid outlet, an interior chamber disposed within said body member, a bearing spindle extending into said chamber and communicating said fluid inlet with said fluid outlet for directing fluid flow therethrough from said fluid inlet to said fluid outlet, said spindle being at least partially disposed within said body member and mounted for relative rotation and axial movement between said bearing spindle and said body member, drive means responsive to fluid flow from said inlet through said bearing spindle for rotating said fluid outlet, a plurality of axially aligned abutting washers disposed within said chamber about a portion of said bearing spindle and extending axially between a second portion of said bearing spindle and a portion of said body member, and a spring member having a predetermined load rate disposed within said chamber about said first portion of said bearing spindle and held in compression by and between said second portion of said bearing spindle and one of said washers, said spring member preloading said washers in compression to maintain a continuous seal between said bearing spindle and said body member and prevent water flowing through said bearing spindle from passing between adjacent surfaces of said bearing spindle and said body member and compressing upon the water pressure within said body member exceeding said load rate, whereupon the bearing friction between said body member and said spindle is not be affected by said spring member.

5. A rotary sprinkler device adapted to be communicated with a water line for the distribution of water therefrom, said device comprising: a fluid inlet; a nozzle head; a body member disposed between said fluid inlet and said nozzle head; an interior chamber disposed within said body member; a bearing spindle extending into said chamber and communicating said fluid inlet with said nozzle head for directing fluid flow therethrough from said fluid inlet to said nozzle head, said spindle being at least partially disposed within said body member and mounted for relative rotation and axial movement between said bearing spindle and said body member; drive means disposed within said chamber and responsive to fluid flow from said inlet through said bearing spindle for rotating said nozzle head, said drive means including a ball track having an abutment surface thereon, a drive ball, means for directing water against said ball to drive said ball in a tangential horizontal direction about said track and against said abutment surface to cause incremental rotation of said track, and means for securing said track to said nozzle head to cause said nozzle head to rotate with said track; an annular sealing means disposed within said chamber about a first portion of said bearing spindle and extending axially between a second portion of said bearing spindle and a portion of said body member; and biasing means having a predetermined load rate disposed within said chamber about said first portion of said bearing spindle and bearing against said sealing means for preloading said sealing means in compression between said second portion of said bearing spindle and said portion of said body member to maintain a continuous seal therebetween, said biasing means compressing upon water pressure within said body member exceeding said load rate, whereupon the bearing friction between said body member and said spindle is not affected by said bearing spring.

6. The sprinkler devices of claims 1 or 5 wherein said sealing means comprises a plurality of axially aligned abutting washers, at least two of said washers being constructed of a resilient material and one of said two being disposed adjacent and in sealing engagement with said portion of said body member, at least one of said plurality of washers being constructed of a metal material and being disposed adjacent and in abutment with said biasing means, and at least one of said plurality of washers being constructed of a synthetic low friction material.

7. The sprinkler devices of claim 1, 4, or 5 wherein said body member defines an upper annular end wall, said end wall having a plurality of elongated arcuate recessed water outlet areas formed therein, each of said areas defining a bottom wall surface and said bottom wall surfaces defining a plurality of differently angled radial planes, said nozzle head abutting said end wall and defining a vertical slot extending radially therethrough, said slot being selectively aligned with one of said plurality of recessed areas to provide an inverted "T" shaped water outlet orifice of selected angular configuration for obtaining a desired fluid flow spray pattern therefrom.

8. A rotary sprinkler device adapted to be communicated with a water line for the distribution of water there from, said device comprising a fluid inlet, a nozzle head, a body member disposed between said fluid inlet and said nozzle head, a bearing spindle communicating said fluid inlet with said nozzle head for directing fluid flow therethrough from said fluid inlet to said nozzle head, said spindle being at least partially disposed within said body member and mounted for relative rotation between said bearing spindle and said body member, drive means responsive to fluid flow from said inlet through said bearing spindle for rotating said nozzle head, said drive means comprising a swirl plate, a drive ball and an annular ball track, said swirl plate being disposed between said fluid inlet and said ball track and in fluid communication therewith and said ball track being disposed between said swirl plate and said nozzle head, said drive ball being disposed in said ball track and said swirl plate defining a plurality of angularly disposed openings therein for causing water passing therethrough to swirl about said ball track and drive said ball in a tangential horizontal direction about said track, said track defining an inwardly protruding surface adapted to be repeatedly abutted by said ball upon said ball being driven about track whereby said track is caused to undergo incremental rotation within said sprinkler device, and means for securing said track to said nozzle head to cause said nozzle head to rotate with said track, an annular sealing means disposed about a first portion of said bearing spindle and extending axially between a second portion of said bearing spindle and a portion of said body member, and biasing means disposed about said first portion of said bearing spindle for preloading said sealing means in compression between said second portion of said bearing spindle and said portion of said body member to maintain a continuous seal therebetween both while water is and is not passing through the sprinkler device.

9. A sprinkler device of claim 8 wherein said biasing means comprises an annular wave spring, said wave spring being held in compression by and between said second portion of said bearing spindle and said sealing means and defining a spring load sufficient to allow said spring to undergo further compression upon the water pressure within said body member reaching 15 p.s.i.

10. The sprinkler device of claim 8 wherein said sealing means comprises a plurality of axially aligned abutting washers, at least two of said washers being constructed of a resilient material and one of said two being disposed adjacent and in sealing engagement with said portion of said body member, at least one of said plurality of washers being constructed of a metal material and being disposed adjacent and in abutment with said biasing means, and at least one of said plurality of washers being constructed of a synthetic low friction material.

11. The combination of claim 10 wherein said biasing means comprises an annular wave spring, said wave spring being held in compression by and between said second portion of said bearing spindle and said sealing means and defining a spring load sufficient to allow said spring to undergo further compression upon the water pressure within said body member reaching 15 p.s.i.

12. The sprinkler device of claim 8 wherein said body member defines an upper annular end wall, said end wall having a plurality of elongated arcuate recessed water outlet areas formed therein, each of said areas defining a bottom wall surface and said bottom wall surfaces defining a plurality of differently angled radial planes, said nozzle head abutting said end wall and defining a vertical slot extending radially therethrough, said slot being selectively aligned with one of said plurality of recessed areas to provide an inverted "T"-shaped water outlet orifice of selected angular configuration for obtaining a desired fluid flow spray pattern therefrom.

13. A rotating sprinkler device adapted to be communicated with a water line for the distribution of water therefrom, said device comprising a fluid inlet adapted to be secured to a water line, a bearing spindle secured to said inlet and extending upwardly therefrom, a body member disposed about a portion of said bearing spindle, extending upwardly therefrom and being rotatable with respect thereto, a nozzle head secured to said body member for rotation therewith, said nozzle head and said body member defining an annular ball track disposed above said bearing spindle, said track having a curvilinear outer upper surface and an abutment surface protruding inwardly therefrom and extending below said upper surface, said bearing spindle communicating with said fluid inlet and said ball track for directing fluid flow therethrough from said fluid inlet to said ball track, a drive ball disposed on said ball track, a swirl plate mounted in the upper end of said bearing spindle and defining a plurality of arcuate inclined slots therein for causing water passing therethrough to swirl about said track and drive said ball in a tangential horizontal direction about said track and against said abutment surface whereby said body member and said nozzle head are caused to undergo incremental rotation about said bearing spindle, said nozzle head and said body member defining a water outlet orifice, an annular sealing means disposed about a first portion of said bearing spindle and extending axially between a second portion of said bearing spindle and a portion of said body member, and biasing means disposed about said first portion of said bearing spindle for preloading said sealing means in compression between said second portion of said bearing spindle and said portion of said body member to maintain a continuous seal therebetween both while water is and is not passing through the sprinkler device.

14. The sprinkler device of claim 13 wherein said biasing means comprises an annular wave spring, said wave spring being held in compression by and between said second portion of said bearing spindle and said sealing means and defining a spring load sufficient to allow said spring to undergo further compression the water pressure within said body member reaching 15 p.s.i.

15. The sprinkler device as in claims 13 or 14 wherein said sealing means comprises a plurality of axially aligned abutting washers, at least two of said washers being constructed of a resilient material and one of said two being disposed adjacent and in sealing engagement with said portion of said body member, at least one of said plurality of washers being constructed of a metal material and being disposed adjacent and in abutment with said biasing means, and at least one of said plurality of washers being constructed of a synthetic low friction material.

16. The sprinkler device of claim 13 wherein said body member defines an upper annular end wall portion, said end wall having a plurality of elongated arcuate recessed water outlet areas formed therein, each of said areas defining a bottom wall surface and said bottom wall surfaces defining a plurality of differently angled radial planes, said nozzle head abutting said end wall and defining a vertical slot extending radially therethrough, said slot being selectively aligned with one of said plurality of recessed areas to provide an inverted "T"-shaped water outlet orifice of selected angular configuration for obtaining a desired fluid flow spray pattern therefrom.

17. The sprinkler device of claim 13 including a plurality of bypass apertures disposed in said bearing spindle below said swirl plate for allowing a portion of the water flowing through said bearing spindle to pass therethrough and upwardly into said ball track, bypassing said inclined slots in said swirl plate whereby the volume of water being directed through said swirl plate is reduced, slowing the velocity of water swirling about said ball track and the speed of rotation of the body member and nozzle head.

18. The sprinkler device as in claims 13, 14, 15 or 17 wherein said fluid inlet comprises a bearing nut, said nut defining a first upstanding cylindrical wall portion engaging said bearing spindle and having an annular horizontal bearing surface at the upper end thereof, a second upstanding wall portion outwardly spaced from said first wall portion and extending upwardly beyond said first wall portion, and a third wall portion outwardly spaced from said second wall portion and defining a tool engagement surface for use in securing said sprinkler device to a water line, said body member defining a depending cylindrical wall portion disposed about a third portion of said bearing spindle and a depending skirt portion outwardly spaced from said depending wall portion and extending about and below a portion of said second wall portion of said bearing nut, said biasing means maintaining said dependable cylindrical wall portion of said body member in abutment with said bearing surface on said bearing nut until the pressure within said body member reaches about 15 p.s.i. whereupon said biasing means compresses and said cylindrical wall portion rises above said bearing surface allowing for free rotation of said body member and nozzle head with respect to said bearing nut, said depending skirt portion on said body member and said second and third wall portions of said bearing nut defining a tortuous path to said bearing surface to restrict foreign matter from passing between said bearing surface and said depending cylindrical wall portion of said body member.

19. The sprinkler device of claim 18 including a filter element disposed below and carried by said bearing nut for restricting the entry of foreign matter into said sprinkler device.

20. The sprinkler device of claim 19 including pressure responsive means carried by said nut member above said filter element for limiting the volume of water passing therethrough into said bearing spindle.

* * * * *

UNITED STATES PATENT AND TRADEMARK OFFICE

CERTIFICATE OF CORRECTION

PATENT NO. : 4,971,256

DATED : November 20, 1990

INVENTOR(S) : Malcolm, William R.

It is certified that error appears in the above-identified patent and that said Letters Patent is hereby corrected as shown below:

Column 34;

Claim 1, line 4, change "within" to --between--

Signed and Sealed this

Ninth Day of February, 1993

*Attest:*

STEPHEN G. KUNIN

*Attesting Officer*

*Acting Commissioner of Patents and Trademarks*